US010896566B2

(12) United States Patent
Umeda

(10) Patent No.: US 10,896,566 B2
(45) Date of Patent: Jan. 19, 2021

(54) COIN RECYCLE DEVICE

(71) Applicant: ASAHI SEIKO CO., LTD., Tokyo (JP)

(72) Inventor: Masayoshi Umeda, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 35 days.

(21) Appl. No.: 16/114,535

(22) Filed: Aug. 28, 2018

(65) Prior Publication Data

US 2019/0073851 A1 Mar. 7, 2019

(30) Foreign Application Priority Data

Sep. 4, 2017 (JP) ..... 2017-169529
Jul. 30, 2018 (JP) ..... 2018-142142

(51) Int. Cl.

| | |
|---|---|
| ***G07D 3/14*** | (2006.01) |
| ***G07D 9/00*** | (2006.01) |
| ***G07D 1/00*** | (2006.01) |
| ***G07D 5/00*** | (2006.01) |

(52) U.S. Cl.

CPC ..... *G07D 3/14* (2013.01); *G07D 1/00* (2013.01); *G07D 5/005* (2013.01); *G07D 9/002* (2013.01); *G07D 9/004* (2013.01); *G07D 9/008* (2013.01)

(58) Field of Classification Search

CPC ..... G07D 3/14; G07D 1/00; G07D 5/005; G07D 9/004; G07D 9/002; G07D 9/008; G07D 3/02; G07D 2201/00

USPC ..... 194/328, 346; 453/7, 11, 56

See application file for complete search history.

(56) References Cited

U.S. PATENT DOCUMENTS

| | | | | |
|---|---|---|---|---|
| 5,355,989 | A * | 10/1994 | Best | G07D 5/00 194/317 |
| 9,430,893 | B1 * | 8/2016 | Blake | G07D 3/16 |
| 9,875,593 | B1 * | 1/2018 | Adams | G07D 3/06 |
| 2003/0201146 | A1 * | 10/2003 | Abe | G07D 1/02 194/302 |

(Continued)

FOREIGN PATENT DOCUMENTS

| | | |
|---|---|---|
| JP | 4764019 B | 8/2011 |
| JP | 4956580 B2 | 6/2012 |

(Continued)

*Primary Examiner* — Jeffrey A Shapiro

(74) *Attorney, Agent, or Firm* — Greenblum & Bernstein, P.L.C.

(57) ABSTRACT

A coin input to a deposit opening is determined a denomination by a coin identifying device, and is allocated and held in a denomination storing and dispensing device in a course of being transported to a coin transporting and distributing device. The coin of a specified denomination is sent from the denomination storing and dispensing device based on a pay-out command, and paid out to a pay-out opening by a pay out transporting device. When the holding amount of the denomination storing and dispensing device becomes full, the coin is not allocated to the denomination storing and dispensing device by the coin transporting and distributing device, but is dropped to an overflow coin slot, guided to an overflow coin guiding tube juxtaposed to the denomination storing and dispensing device and held in an overflow coin storing unit arranged on the lower side of the denomination storing and dispensing device.

4 Claims, 23 Drawing Sheets

(56) References Cited

U.S. PATENT DOCUMENTS

| | | | | |
|---|---|---|---|---|
| 2006/0254877 | A1* | 11/2006 | Mulvey | G07D 5/00 194/302 |
| 2006/0278495 | A1* | 12/2006 | Umeda | G07D 3/14 194/303 |
| 2007/0007104 | A1* | 1/2007 | Piccirillo | G07D 5/005 194/317 |
| 2007/0010186 | A1* | 1/2007 | Karlson | G07D 3/14 453/3 |
| 2009/0057093 | A1* | 3/2009 | Iwami | G07F 19/20 194/206 |
| 2012/0012437 | A1* | 1/2012 | Matsumoto | G07D 9/00 194/342 |
| 2012/0295528 | A1* | 11/2012 | Itou | G07D 3/14 453/57 |
| 2013/0322730 | A1* | 12/2013 | Borg | G06K 9/6224 382/136 |

FOREIGN PATENT DOCUMENTS

| | | | |
|---|---|---|---|
| JP | 5749037 | B2 | 7/2015 |
| JP | 2016-66272 | A | 4/2016 |
| JP | 2017-138987 | A | 8/2017 |

* cited by examiner

COIN RECYCLE DEVICE

TECHNICAL FIELD

The present invention relates to a so-called circulating type coin recycle device, in which a received coin is used as a pay out coin, used in automatic fare adjustment machine, bank counter auxiliary machine, and the like.

Specifically, the present invention relates to a circulating type coin recycle device in which when the received coins overflow, the overflowed coins are efficiently stored.

The term "coin" used in the present specification is a concept including also a deformed octagonal shape, and the like such as a 20 pence coin and a 50 pence coin of British in addition to a circular plate shape such as a coin, a token and the like having a predetermined thickness and diameter. The term "overflow" means that the number of coins held in a denomination storing and dispensing device exceeds a set predetermined holding number. Furthermore, terms that indicate an order such as "first", "second" and the like are merely used to distinguish the same component names, and are not taken into consideration in interpreting the rights.

BACKGROUND ART

For this type of first conventional technique, a device including a coin receiving slot that receives a coin from outside a machine body; a storing and drawing device to which the coin received by the coin receiving slot is sent to store the coin and that draws the stored coin one at a time; a received coin transportation unit that transports the coin drawn by the storing and drawing device one at a time; an identification unit that is arranged in the received coin transportation unit to identify the coins transported by the received coin transportation unit; and a plurality of accommodating drawing units arranged on the lower side of the received coin transportation unit to accommodate the coins, each accommodating drawing unit being sent with coins from the received coin transportation drawing unit to accommodate the coins, and drawing the accommodated coins one at a time, where the received coin transportation unit includes an upper transporting portion extending along a substantially horizontal direction, a turn-back transporting portion that transports the coin sent from the upper transporting portion and changes the transporting direction of the coin to an opposite direction, and a lower transporting portion that is arranged on the lower side of the upper transporting portion, extended along the substantially horizontal direction, and that transports the coin sent from the turn-back transporting portion; the coin drawn from the storing and drawing device is transported in the order of the upper transporting portion, the turn-back transporting portion, and the lower transporting portion; a sorting portion that sorts the coin based on the identification result of the coin by the identification unit is arranged in the upper transporting portion and the lower transporting portion; the coin sorted by each sorting portion is sent to the accommodating drawing unit; the overflow coin is fed to an overflow box juxtaposed to the storing and drawing device; the coin of the held denomination is sent out from the plurality of accommodating drawing units to a drawer arranged on the lower side of the plurality of accommodating drawing units by a pay-out or a collecting command, and the coin is collected by denomination pulling out the drawer box is known (patent document 1).

For a second conventional technique, a circulating type coin recycle device that receives a deposited coin and sends the deposited coin to a denomination coin accommodating discharging device, and withdraws a withdrawing coin discharged from the denomination coin accommodating discharging device, where a coin accommodating cassette capable of discharging a supplementary coin to be supplied to the denomination coin accommodating discharging device and capable of receiving a supplementary overflow coin that does not need to be supplied to the denomination coin accommodating discharging device, a transportation conveyor means that includes a receiving conveyor region arranged on a bottom portion side of the circulating type coin recycle device, that receives the supplementary coin discharged from the coin accommodating cassette and sends the coin to the denomination coin accommodating discharging device, and receives the withdrawing coin discharged from the denomination coin accommodating discharging device in the receiving conveyor region, and a control unit that supplies the supplementary coin discharged from the coin accommodating cassette to the denomination coin accommodating discharging device through the transportation conveyor means and collects and accommodates the supplementary overflow coin that does not need to be supplied to the denomination coin accommodating discharging device to the coin accommodating cassette at the time of the supplying process, and that withdraws the withdrawing coin discharged from the denomination coin accommodating discharging device through the transportation conveyor means at the time of the withdrawing process is known (patent document 2).

For a third conventional technique, a circulating type coin recycle device including a coin receiving unit capable of receiving and discharging a coin, a storing drawing unit that stores the coin discharged from the coin receiving unit and draws the coin one at a time, a coin identification unit arranged from the storing drawing unit to the coin receiving unit to transport the coin drawn one at a time from the storing drawing unit and identify the coin, a coin passage including an overflow coin branching portion that branches the overflow coin at the time of deposit and a denomination coin branching portion that branches the coin by denomination, a denomination coin temporary holding unit arranged side by side on the lower side of the denomination coin branching portion along the coin passage to temporarily hold the coin branched by denomination at the denomination coin branching portion, send the temporarily held coin to the accommodating side at the time of storage and discharge the coin to the returning side at the time of return, denomination coin accommodating discharging unit that is arranged side by side on the lower side of the denomination coin temporarily holding unit to be able to accommodate the coin sent from the denomination coin temporarily holding unit to the accommodating side and to discharge the coin by denomination, a supplementary coin accommodating unit that accommodates the supplementary coin and discharges the supplementary coin, and a transportation conveyor including a receiving conveyor region arranged in a bottom region of the machine body and a sending conveyor region inclined upward from one end of the receiving conveyor region toward the storing drawing unit, the sending conveyor region receiving the overflow coin at the time of deposit branched at the overflow coin branching portion of the coin passage, the receiving conveyor region receiving the return coin discharged from the denomination coin temporarily holding unit to the returning side, the withdrawing coin discharged from the denomination coin accommodating discharging unit, and the supplementary coin discharged from the supplementary coin accommodating unit, the coins being transported to one end side and sent to the storing drawing unit is known (patent document 3).

For a fourth conventional technique, a coin recycle device including a deposit transportation error detecting unit that detects a transportation error when the transportation error occurs in transporting a coin by a received coin transportation unit, an overflow sorting unit arranged in the received coin transportation unit to sort the coin transported by the received coin transportation unit to send the coin to a pay-out transportation unit arranged separate from the received coin transportation unit, and a control unit that carries out the control of at least the received coin transportation unit and the overflow sorting unit so that the coin transported by the received coin transportation unit is sent to the pay-out transportation unit by the overflow sorting unit when the transportation error is detected by the deposit transportation error detecting unit is known (patent document 4).

For a fifth conventional technique, a settlement device including a housing having an open/closable door on a front surface, a planar portion that exists across a central portion in a width direction of the housing and has a shape long in the width direction to be able to mount coin, a coin recycle device that is accommodated in the housing so as to be closer to one of the side walls in the width direction of the housing and across the central portion in the width direction and that accommodates a coin retrieved from a coin receiving slot continuing from the planar portion and discharges a change to a coin withdrawing slot, and a container accommodated arranged in the housing, attached to the coin recycle device so as to be detachable by opening the door, and having a shape that fills the space at least at one portion, a coin evacuated from the coin recycle device being accommodated in at least the relevant portion is known (patent document 5).

PRIOR ART REFERENCES

Patent Documents

[Patent document 1] Japanese Patent No. 5749037 (FIGS. 1 to 12, paragraphs 0034, 0046, 0082, 100)

[Patent document 2] Japanese Patent No. 4956580 (FIGS. 1 to 21, paragraphs 0008, 0026 to 0031, 0038, 0057 to 0058, 0082 to 0091)

[Patent document 3] Japanese Patent No. 4764019 (FIGS. 1 to 7, paragraphs 0007-0008, 0017-0087)

[Patent document 4] Japanese Unexamined Patent No. 2016-66272 (FIGS. 1 to 6, paragraphs 0015 to 0032, 0037 to 0039)

[Patent document 5] Japanese Unexamined Patent No. 2017-138987 (FIGS. 1 to 8, paragraphs 0006, 0024 to 0032)

DISCLOSURE OF THE INVENTION

Problems to be Solved by the Invention

In the first conventional technique, the coin of the overflow denomination is sorted before being accommodated in the accommodating drawing device and collected in the overflow box, but as the overflow box is juxtaposed to the storing and drawing device at the upper side, its capacity is limited and sufficient overflow coin storage amount may not be ensured, and the device may enlarge if sufficient coin storage amount is ensured.

In the second conventional technique, the coin of the overflow denomination is sorted before being accommodated in the denomination coin accommodating discharging device and collected in the coin accommodating cassette, but as the coin accommodating cassette is juxtaposed to the denomination coin accommodating discharging device, sufficient overflow coin storage amount may not be ensured, and the device may enlarge if sufficient coin storage amount is ensured, similar to the first conventional technique.

In the third conventional technique, the received coin can be efficiently used as the overflow coin at the time of deposit is received in the sending conveyor region and used as the withdrawing coin, but a transportation device and the like for supplying the overflow coin to the denomination coin accommodating discharging unit become necessary, thus leading to enlargement of the device.

In the fourth conventional technique, the overflow coin accommodating unit is arranged on the lower side of the accommodating drawing device for every denomination arranged in the housing, and the overflow coin is fed out from the accommodating drawing device for every denomination onto the belt and accommodated in the overflow coin accommodating unit by the transportation movement of the belt. As such belt is also used for coin transportation for pay-out, the pay-out process may not be carried out during the overflow resolving work.

In the fifth conventional technique, a collecting bag such as a container is accommodated in the housing of the settlement device, and the change is fed out from the denomination coin holding unit in the coin recycle device onto a coin discharging plate or the coin withdrawing slot, where when the coin holding unit is overflowed, the coin is collected to the collecting bag on the lower side of the coin discharging plate from the coin holding unit to avoid the settlement device from pausing by overflow. According to such configuration, when overflow occurs, the coin is fed out from the coin holding unit and collected in the collecting bag, and thus the withdrawing process may not be carried out at the time of the overflow resolving work.

Furthermore, a fake coin is sometimes intentionally inserted into the coin recycle device. When the fake coin is determined, the coin is conventionally returned to the return slot. However, when the fake coin is returned, it may be determined and processed as a genuine coin as a result of intentionally inserting the fake coin to a different coin processing device. Furthermore, when switched to a new coin, the old coin (hereinafter referred to as "old coin") is preferably collected as fast as possible. Moreover, as there is a possibility a contaminated coin that is defaced badly is mistaken for the fake coin, it is not appropriate to continue the use of such coin in the market. The contaminated coin is a coin that is, although it is a genuine coin, suspected of being a genuine coin because the coin is dirty or damaged.

It is a first object of the present invention to provide a coin recycle device in which a processing of an overflow coin and a withdrawing or depositing process can be executed simultaneously, and in which a storage amount of the overflow coin can be sufficiently ensured without enlarging. Additionally, it is a second object to retrieve and collect a fake coin, old coin, or contaminated coin without returning it to a return slot.

Means for Solving the Problems

To achieve the above objects, the first invention according to claim 1 has the following configuration. A coin recycle device that determines a denomination of a coin input to a deposit opening of the coin, distributes and allocates the coin to denomination storing and dispensing device arranged in parallel by a coin transporting and distributing device and holds the coin in the denomination storing and dispensing device, and drops a specified number of coins on a common pay out transporting device arranged along the denomination storing and dispensing device one at a time from an outlet of the denomination storing and dispensing device based on a pay-out command to pay out to a pay-out opening; the coin recycle device including an overflow coin slot integrally arranged with the coin transporting and distributing device; and an overflow coin guiding tube installed in parallel with the denomination storing and dispensing device to guide an overflow coin dropped to the overflow coin slot to an overflow coin storing unit installed on the lower side.

The second invention according to the present invention relates to the coin recycle device of the first invention, where the overflow coin holding unit is installed in an overflow coin storing chamber arranged on a lower side of the denomination storing and dispensing device.

The third invention according to the present invention relates to the coin recycle device of the second invention, where the overflow coin storing chamber is opened/closed by a door, the door including a locking device.

The fourth invention according to the present invention relates to the coin recycle device of the second or third invention, further including a pay-out distributing device that guides the coin paid out from the outlet of the denomination storing and dispensing device to the pay out transporting device or the overflow coin storing chamber on a lower side; and a denomination collected coin storing unit arranged in the overflow coin storing chamber to store the coin paid out from the denomination storing and dispensing device for every denomination.

The fifth invention according to the present invention relates to the coin recycle device of the fourth invention, where the locking device is common with respect to the overflow coin storing unit and the denomination collected coin storing unit.

The sixth invention according to the present invention relates to a coin recycle device including a coin identifying device that determines a denomination of a coin input to a deposit opening of the coin, a coin transporting and distributing device that transports a genuine coin identified by the coin identifying device and to be received, and allocates the coin for every denomination, a denomination storing and dispensing device that holds the coin allocated by denomination by the coin transporting and distributing device and that is arranged in parallel, and a pay out transporting device, arranged along the denomination storing and dispensing device, that transports the coin paid out one at a time from the outlet of the denomination storing and dispensing device based on a pay-out command toward a pay-out opening; the coin recycle device including an overflow coin slot integrally arranged with the coin transporting and distributing device; and an overflow coin guiding tube arranged in parallel with the denomination storing and dispensing device to guide an overflow coin dropped to the overflow coin slot to an overflow coin storing unit; where a collecting coin determining device that determines a coin to be collected and outputs a collecting coin signal is further arranged; the coin transporting and distributing device transports the coin to be collected based on the collecting coin signal, and drops the coin to be collected in the overflow coin slot; and the coin to be collected dropped in the overflow coin slot is guided to the overflow coin guiding tube.

The seventh invention according to the present invention relates to the coin recycle device of the sixth invention, where the collecting coin signal is output based on a fake coin signal.

The eighth invention according to the present invention relates to the coin recycle device of the seventh invention, where a fake coin distributing device that allocates the coin to an overflow coin and a fake coin based on a fake coin signal from the collecting coin determining device is arranged downstream of an overflow coin guiding tube lower end opening of the overflow coin guiding tube; and the fake coin is allocated to a fake coin storing unit different from the overflow coin storing unit.

The ninth invention according to the present invention relates to the coin recycle device of the sixth invention, where the collecting coin signal is output based on a contaminated coin signal.

The tenth invention according to the present invention relates to the coin recycle device of the ninth invention, where the collecting coin determining device includes an image sensor.

Effects of the Invention

According to the first invention, a denomination of a coin is determined, and thereafter, the coin is distributed and allocated to denomination storing and dispensing devices by a coin transporting and distributing device and held in the denomination storing and dispensing device. An overflow coin slot is integrally arranged with the coin transporting and distributing device. In other words, the denomination that overflowed in the denomination storing and dispensing device is distributed to the overflow coin slot arranged separate from the denomination storing and dispensing device. That is, even the overflow denomination can be drawn from the denomination storing and dispensing device, and can also be deposited. Furthermore, the coin allocated to the overflow coin slot is guided by an overflow coin guiding tube installed in parallel with the denomination storing and dispensing device and stored in an overflow coin storing unit. In other words, since the size of the overflow coin storing unit is not substantially subjected to restriction, sufficient holding amount can be ensured. Thus, a coin recycle device in which a processing of an overflow coin and a withdrawing or depositing process can be executed simultaneously, and in which a sufficient storage amount of the overflow coin can be ensured without enlarging can be provided, thus realizing the first object of the present invention.

The second invention has the same basic configuration as the first invention, and thus the first object of the present invention can be achieved. Furthermore, in the second invention, the coin allocated to the overflow coin slot is guided by the overflow coin guiding tube installed in parallel to the denomination storing and dispensing device, and stored in the overflow coin storing unit arranged on the lower side of the denomination storing and dispensing device. In other words, since the overflow coin storing chamber is arranged on the lower side of the denomination storing and dispensing device, the lower space of the denomination storing and dispensing device can be effectively used, and hence the device is not further enlarged.

The third invention has the same basic configuration as the first invention, and thus the first object of the present invention can be achieved. Furthermore, in the third invention, the overflow coin storing unit is installed in the overflow coin storing chamber opened/closed by the door, which door is locked or unlocked by the locking device. When the locking device of unlocked, the door can be opened and the overflow coin storing unit can be taken out, but during the operation of the coin recycle device, it can be locked by the locking device and thus the safety can be enhanced. In other words, since the overflow coin storing unit is removable with respect to the coin recycle device, when such overflow coin storing unit becomes full, it can be unlocked by the locking device to replace it with another empty overflow coin storing unit and collect the overflow coins.

The fourth invention has the same basic configuration as the first invention, and thus the first object of the present invention can be achieved. Furthermore, in the fourth invention, a pay-out distributing device that guides the coin paid out from the outlet of the denomination storing and dispensing device to the pay out transporting device or a denomination collected coin storing unit in the overflow coin storing chamber on a lower side; and a denomination collected coin storing unit arranged in the overflow coin storing chamber to store the coin paid out from the denomination storing and dispensing device for every denomination are arranged. Therefore, when collecting all the coins in the denomination storing and dispensing device, the coins can be drawn to the denomination storing unit at the same time by setting the distributing destination of the pay-out distributing device to the denomination collected coin storing unit, whereby the coins can be collected in a short time by denomination.

The fifth invention has the same basic configuration as the first invention, and thus the first object of the present invention can be achieved. Furthermore, in the fifth invention, the locking device is common to the overflow coin storing unit and the denomination collected coin storing unit, and thus the number of locking devices can be reduced and the cost can be reduced.

In the sixth invention, when the collecting coin determining device determines the collecting coin to be collected such as fake coin, contaminated coin, old coin and the like, the collecting coin signal is output. In this case, similar to the coin of the denomination that overflowed, the collecting coin to be collected is transported by the coin transporting and distributing device. Furthermore, the overflow coin slot is integrally arranged with the coin transporting and distributing device, and the coin of the denomination that overflowed in the denomination storing and dispensing device is distributed to the overflow coin slot arranged separate from the drop slot to the denomination storing and dispensing device. In other words, even the coin of the denomination that overflowed can be drawn from the denomination storing and dispensing device, and furthermore, can be deposited by being dropped to the overflow coin slot. Moreover, the coins allocated to the overflow coin slot are guided by the overflow coin guiding tube installed in parallel to the denomination storing and dispensing device, and stored in the overflow coin storing unit drawn from the denomination storing and dispensing device. That is, since the size of the overflow coin storing unit is not substantially subjected to restriction, sufficient holding amount can be ensured. Therefore, a coin recycle device in which a processing of an overflow coin and a withdrawing or depositing process can be executed simultaneously, and in which a storage amount of the overflow coin can be sufficiently ensured without enlarging can be provided, thus realizing the first object of the present invention. Furthermore, the coin to be collected such as fake coin, and the like is also transported by the coin transporting and distributing device, dropped to the overflow coin slot, and guided by the overflow coin guiding tube. The collecting coin such as the fake coin and the like that may be reused is thus collected, and the subsequent intentional misuse, and the like can be prevented, thus also realizing the additional second object.

The seventh invention has the same basic configuration as the sixth invention, and thus the first object and the second object of the present invention can be achieved. Furthermore, in the seventh invention, the collecting coin signal is output based on the fake coin signal, and thus the fake coin is taken in and collected in the coin recycle device, whereby the subsequent intentional misuse can be prevented.

The eighth invention has the same basic configuration as the sixth invention, and thus the first object and the second object of the present invention can be achieved. Furthermore, in the eighth invention, a fake coin distributing device that allocates the coin to an overflow coin and a fake coin based on a fake coin signal from the coin identifying device is arranged downstream of an overflow coin guiding tube lower end opening of the overflow coin guiding tube; and the fake coin is allocated to a fake coin storing unit different from the overflow coin storing unit. Thus, the fake coin is allocated to the fake coin storage unit different from the overflow coin. Therefore, the fake coin and the overflow coin are allocated to different storage units, whereby the trouble of sorting can be omitted.

The ninth invention has the same basic configuration as the sixth invention, and thus the first object and the second object of the present invention can be achieved. Furthermore, in the ninth invention, the collecting coin signal is output based on the contaminated signal, and thus the coins that are contaminated such as dirt, deformation, scratches, color change, rust etc. can also be collected.

The tenth invention has the same basic configuration as the sixth invention, and thus the first object and the second object of the present invention can be achieved. Furthermore, in the tenth invention, the collecting coin determining device includes the image sensor, whereby the contaminated coin can be determined and collected by a relatively inexpensive device.

BRIEF DESCRIPTION OF THE DRAWINGS

FIG. 17A shows a front view and FIG. 17B shows a cross-sectional view.

BEST MODE FOR CARRYING OUT THE INVENTION

Figure 1:
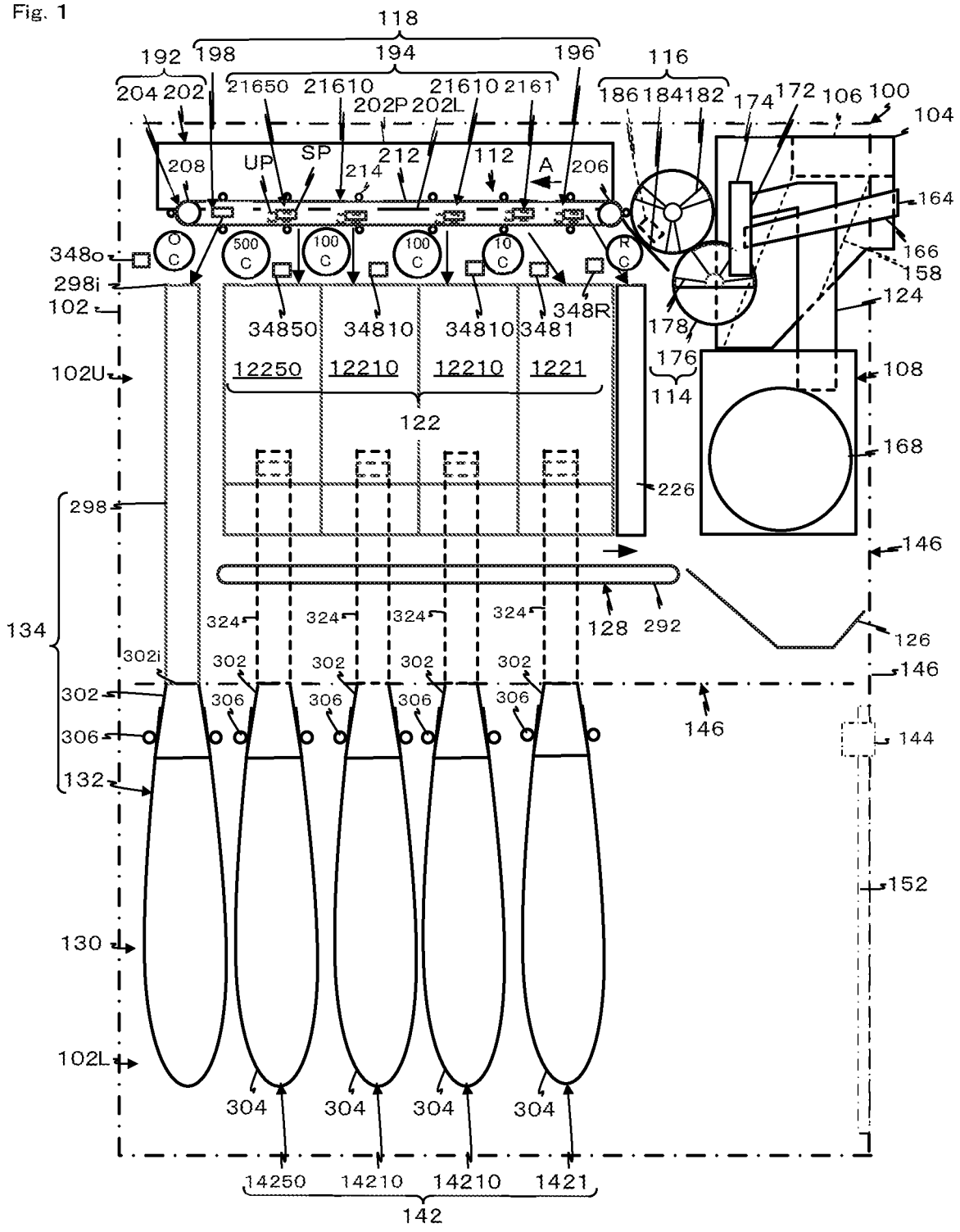
FIG. 1 is an explanatory view of an outline of a coin recycle device of a first example according to the present invention.

A best mode of a disc body processing device according to the present invention is a coin recycle device that determines a denomination of a coin input to a deposit opening of a coin, distributes and allocates the coins to a denomination storing and dispensing devices arranged in parallel by a coin transporting and distributing device and holds the coin in the denomination storing and dispensing device, drops a specified number of coins on a common pay out transporting device arranged along the denomination storing and dispensing device one at a time from an outlet of the denomination storing and dispensing device based on a pay-out command to pay out the coin to a pay-out opening, the device including an overflow coin slot integrally arranged with the coin transporting and distributing device, an overflow coin guiding tube installed in parallel with the denomination storing and dispensing device to guide the overflow coin dropped to the overflow coin slot to an overflow coin storing unit installed on the lower side, the overflow coin storing unit installed in an overflow coin storing chamber arranged on the lower side of the denomination storing and dispensing device, a pay-out distributing device that guides the coin paid out from the outlet of the denomination storing and dispensing device to the pay out transporting device or the overflow coin storing chamber on the lower side, a denomination collected coin storing unit arranged in the overflow coin storing chamber to store the coin paid out from the denomination storing and dispensing device for every denomination, and a locking device that locks the overflow coin storing chamber, where the locking device is common among the overflow coin storing unit and the denomination collected coin storing unit.

First Example

In the description of the first example, a coin C will be described using a Japanese yen, a 10 yen coin 10C, a 100 yen coin 100C and a 500 yen coin 500*c*, by way of example, and a collective term coin C will be used other than when there is a need to describe a particularly specified denomination. However, the present invention is not limited to the Japanese yen, and can be used with respect to the coin C all around the world such as Euro coin, US coin, British coin, Chinese coin, and the like.

A coin recycle device 100 has a function of receiving coins C of a plurality of denominations, and paying out the coin C of a predetermined denomination by a predetermined number by a pay-out command PD, and is formed to an elongate box shape as a whole by being configured by a cubic shaped housing 102, and a coin recycle unit 104 fitted with one part exposed to an upper space 102U of the housing 102. In the first example, the coin recycle unit 104 includes a deposit opening 106, a coin sending device 108, a coin aligning and sending device 114, a coin identifying device 116, a coin transporting and distributing device 118, a denomination storing and dispensing device 122, a coin lifting device 124, a pay-out opening 126, a pay out transporting device 128, an overflow coin storing unit 132, and an overflow coin processing device 134, and furthermore, includes a pay-out distributing device 138, a denomination collected coin storing unit 142, and a locking device 144.

First, the housing 102 will be described with reference mainly to FIG. 1.

The housing 102 at least incorporates the coin recycle unit 104 and forms an overflow coin storing chamber 130 on the lower side of the coin recycle unit 104, has a function serving as the housing 102 of the coin recycle device 100, is formed to an elongate box shape in the first example, divided to an upper space 102U and a lower space 102L by an intermediate bottom 146 installed horizontal at an intermediate of an up and down direction, and includes a door 152 of the overflow coin storing chamber 130 at a lower part of a front surface 148. For example, the door 152 has a left end attached in a freely turnable manner about a vertical shaft to the housing 102 by means of a hinge 154, and is locked or unlocked with respect to the housing 102 by the locking device 144. In other words, the overflow coin storing chamber 130 becomes a closed space by closing the door 152, and work can be carried out in the overflow coin storing chamber 130 by opening the door 152.

Next, the coin recycle unit 104 will be described with reference mainly to FIG. 1.

The coin recycle unit 104 has a function of separating the received coins C one by one, and thereafter, carrying out a genuine/fake determination and a denomination determination, distributing a predetermined denomination, which is a genuine coin, to the denomination storing and dispensing device 122, sending out the coin C of a number specified by denomination from the denomination storing and dispensing device 122 to the common pay out transporting device 128 one at a time and sending out to the pay-out opening 126 by the pay out transporting device 128, and sending the overflow coin OC to the overflow coin storing unit 132 based on a pay-out command PO, and in the first example, as described above, includes the deposit opening 106 to which a great number of coins C can be inserted at once, the coin sending device 108 that separates and sends out the coin C one at a time, the coin aligning and sending device 114 that aligns the coins C one at a time and sends out the coin to a coin moving path 112, the coin identifying device 116 that identifies the genuine/fake and the denomination of the coin C in the coin moving path 112, the coin transporting and distributing device 118 that allocates the coin C identified as the genuine coin TC (FIG. 7) in the coin identifying device 116 by denomination, the denomination storing and dispensing device 122 that accommodates the coin C allocated by the coin transporting and distributing device 118 by denomination and paying out the accommodated coin one at a time, the coin lifting device 124 that transports the coin C sent out from the coin sending device 108 toward the coin aligning and sending device 114, the pay out transporting device 128 that transports the coin C paid out from the denomination storing and dispensing device 122 toward the pay-out opening 126, the overflow coin storing unit 132 that holds the overflow coin OC, the overflow coin processing device 134 that processes the overflow coin OC, the pay-out distributing device 138 that guides the coin C paid out from the outlet 136 of the denomination storing and dispensing device 122 to the pay out transporting device 128 or the denomination collected coin storing unit 142, the denomination collected coin storing unit 142 arranged in the overflow coin storing chamber 130 to store the coin C paid out from the denomination storing and dispensing device 122 for every denomination, and the locking device 144 that locks the overflow coin storing chamber 130, and thus at least the overflow coin storing unit 132.

Figure 2:
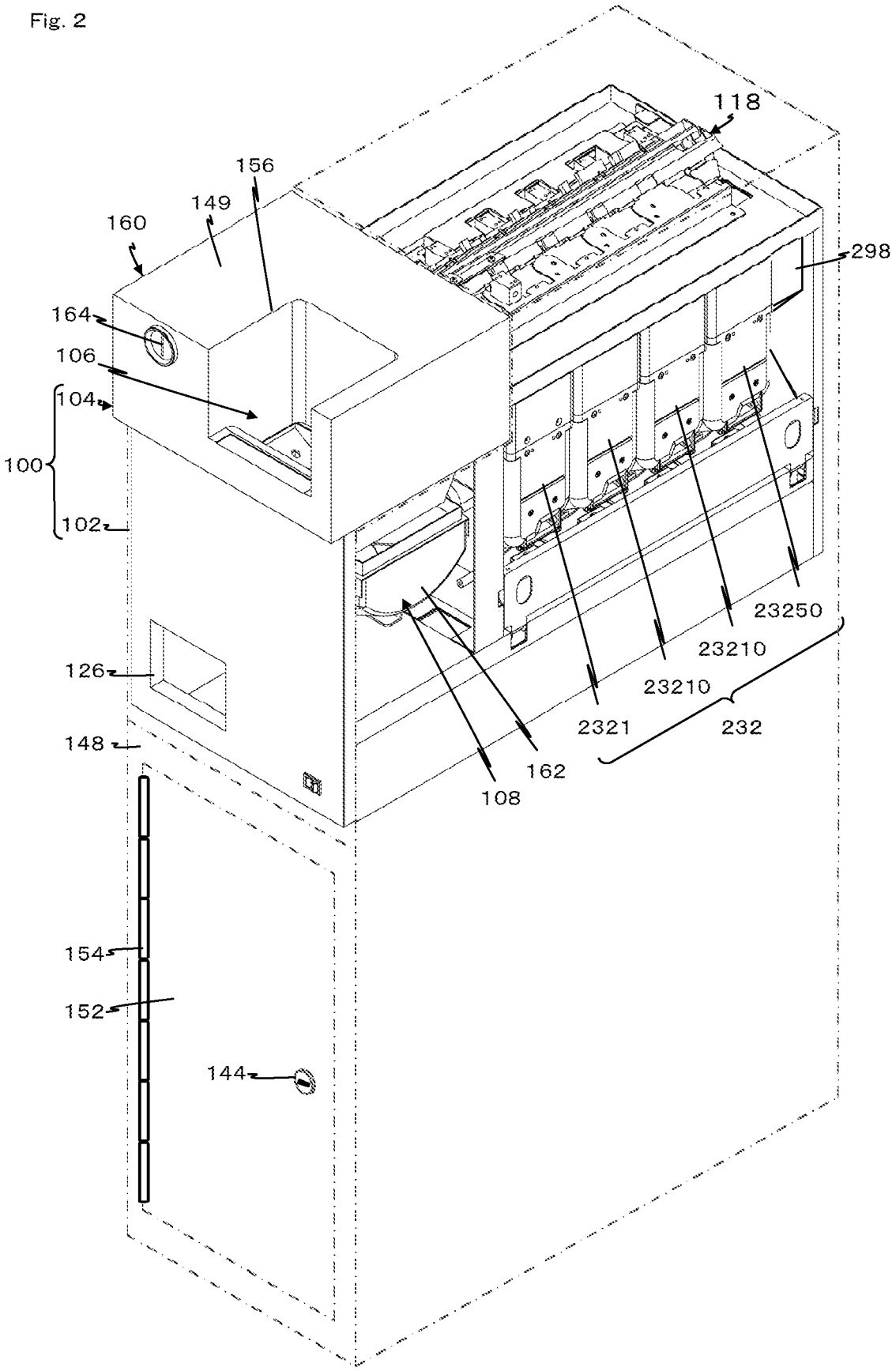
FIG. 2 is a perspective view seen from an upper right of a front side of the coin recycle device of the first example according to the present invention.

First, the deposit opening 106 will be described with reference mainly to FIG. 2.

The deposit opening 106 has a function of enabling the coin C to deposit to the coin recycle device 100, in other words, the coin recycle unit 104 to be collectively inserted, and in the first example, it is formed deviated toward the right side of a rectangular box shaped deposit head 160 forming an upper part of the front side of the coin recycle unit 104, the front surface 148 side and an upper surface 149 side are formed to a recess 156 opened to a rectangular shape, the bottom portion being connected to a storage container 162 of the coin sending device 108 by a tubular guiding passage 158 extending in the up and down direction. In other words, a great amount of coins C can be inserted at once to the deposit opening 106 in the initial withdrawing coin preparing work, and the like. In FIG. 2, an elongate groove arranged on the left side of the deposit opening 106 is a one-coin inserting slot 164 for inserting the coin C one at a time, and is guided to the storage container 162 by one guiding passage 166 extending in the up and down direction. However, the one-coin inserting slot 164 may not be arranged.

The coin sending device 108 will now be described with reference mainly to FIG. 1.

Figure 4:
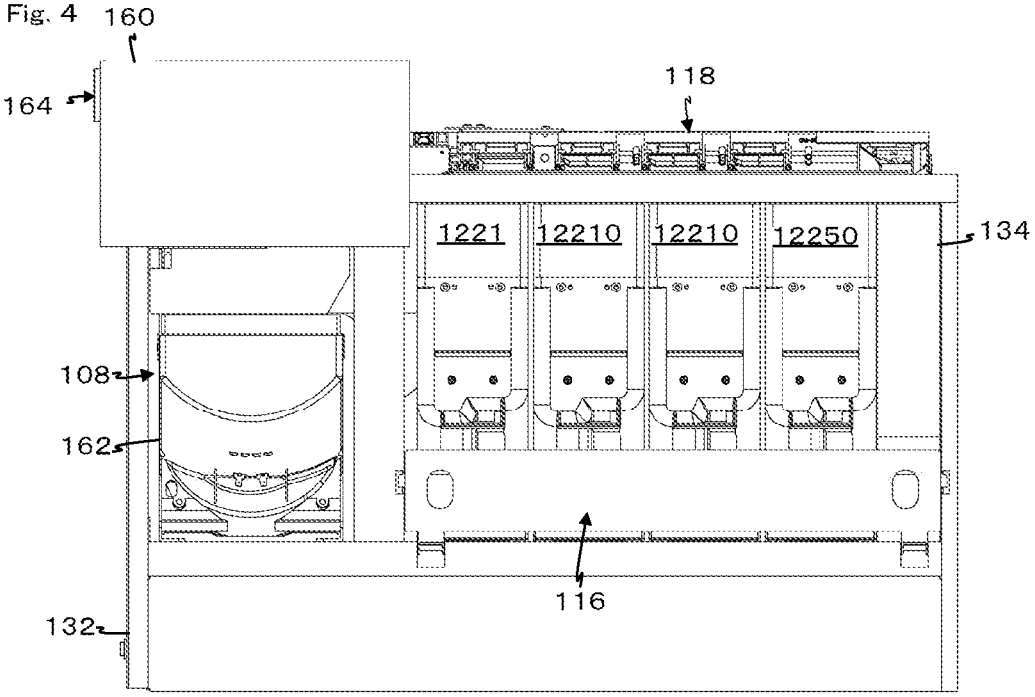
FIG. 4 is a right side view of the main portion of the coin recycle device of the first example according to the present invention.
Figure 5:
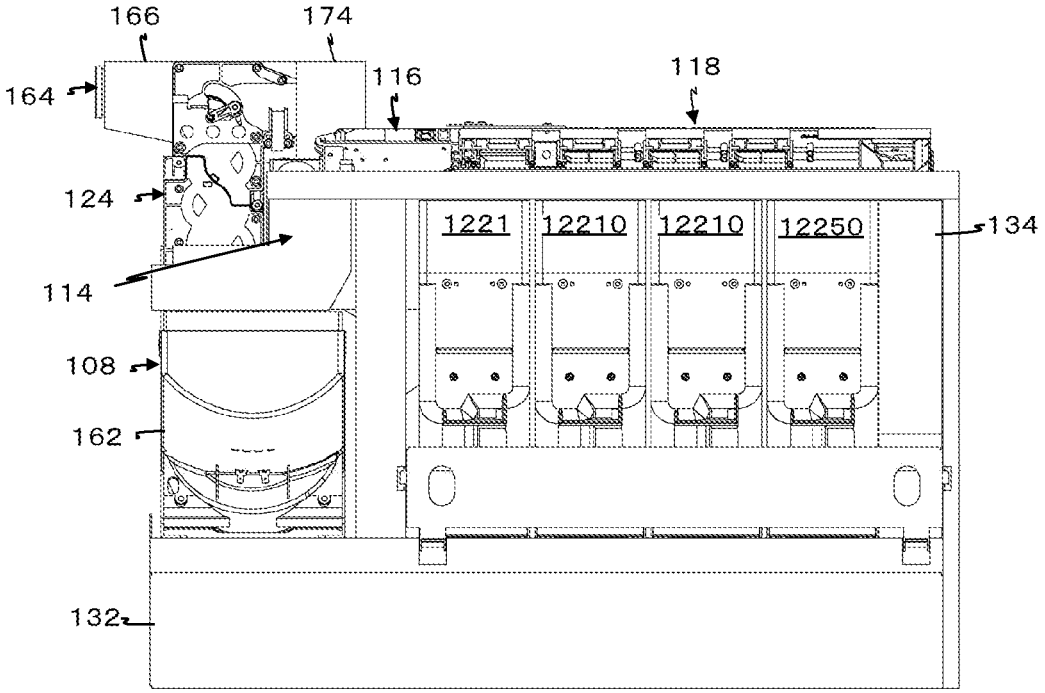
FIG. 5 is a right side view in which a cover of one part of the main portion of the coin recycle device of the first example according to the present invention is removed.
Figure 6:
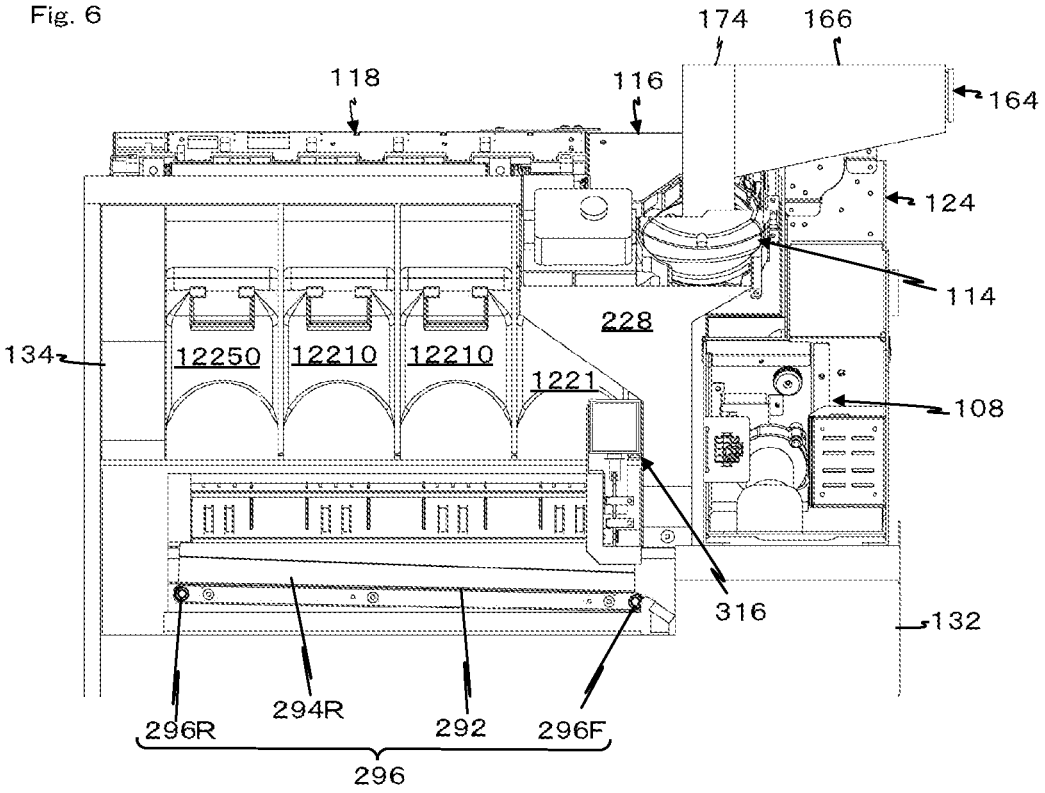
FIG. 6 is a left side view of the main portion of the coin recycle device of the first example according to the present invention.

The coin sending device 108 has a function of separating and sending the bulk coins C one by one to supply the coin C received from the deposit opening 106 or the one-coin inserting slot 164 to the coin aligning and sending device 114 on the upper side, and is generally configured to pick up and send the bulk coin C in the storage container 162 one at a time by the rotation of a rotating disc 168 having the storage container 162 (FIG. 4) and a push-out protrusion (not shown) of the coin C radially extending in the peripheral direction on an upper surface located diagonally in the storage container 162.

The coin lifting device 124 will now be described.

The coin lifting device 124 has a function of transporting the coin C sent out one at a time from the coin sending device 108 to the upper side one at a time, and sending the coin out from an upper exit 172, where a known lifting device can be used. For example, a device described in Japanese Patent Publication No. 5838432 related to the application of the present applicant is preferably used for the coin sending device 108 and the coin lifting device 124. In the first example, configuration is such that the coin is sent out to a coin guide 174 from the upper exit 172.

Now, the coin guide 174 will be described with reference mainly to FIG. 1.

The coin guide 174 has a function of guiding the coin C received from the upper exit 172 to the coin aligning and sending device 114 on the lower side, and in the first example, is configured by a tubular body to guide the coin C sent out swiftly from the upper exit 172 to an aligning and sending storage container 176 of the coin aligning and sending device 114. Thus, when the coin C sent out from the upper exit 172 can be reliably transferred to the aligning and sending storage container 176, the coin guide 174 can be omitted.

The coin aligning and sending device 114 will now be described with reference mainly to FIG. 1.

The coin aligning and sending device 114 has a function of again separating the coin C supplied through the coin guide 174 by the coin lifting device 124 one by one and sending out the coin to the coin identifying device 116, and in the first example, sends out the coin C one at a time to the coin identifying device 116 on the downstream by a combination of a semi-circular recess formed on an upward upper surface of an inclined rotating body 178 and a moving body. In other words, the coin aligning and sending device 114 is generally configured by the aligning and sending storage container 176 and the rotating body 178 to separate the coin C held in a bulk state in the aligning and sending storage container 176 one by one by the rotation of the rotating body 178, and then send out the coin in the peripheral direction of the rotating body 178. For example, devices described in Japanese Patent Publication No. 4910116, Japanese Patent Publication No. 5756953, or Japanese Patent Publication No. 5716199 related to the application of the present applicant can be used for the coin aligning and sending device 114.

Now, the coin identifying device 116 will be described with reference mainly to FIG. 1.

The coin identifying device 116 has a function of detecting a physical property of the coin C with a physical sensor 186 while moving the coin C sent out from the coin aligning and sending device 114 along a guide 184 by a rotation of a rotation blade 182, carrying out the genuine/fake determination and the denomination determination in a control device 288, to be described later, based on the output of the physical sensor 186, and then transferring the coin to the coin transporting and distributing device 118. For example, devices described in Japanese Patent Publication No. 4780494, Japanese Patent Publication No. 5261662, or Japanese Unexamined Patent Publication No. 2016-115172 related to the application of the present applicant can be used for the coin identifying device 116.

Now, the coin transporting and distributing device 118 will be described with reference mainly to FIG. 1.

The coin transporting and distributing device 118 has a function of distributing the coin C sent from the coin identifying device 116 to at least the denomination coin C, or as Japanese yen is adopted in the first example, to the 10 yen coin 10C, the 50 yen coin, the 100 yen coin 100C, the 500 yen coin 500C, the overflow coin OC, or the return coin RC, and in the first example, is configured by a coin transporting device 192, a denomination coin slot 194, a return coin slot 196, and an overflow coin slot 198. The used coin in the first example is set to the 10 yen coin 10C, the 100 yen coin 100C, and the 500 yen coin 500C, and the 50 yen coin 50C is excluded.

First, the coin transporting device 192 will be described with reference to FIGS. 1 and 7.

The coin transporting device 192 has a function of moving the coin C sent from the coin identifying device 116 in a predetermined direction along the guide body 202, and in the first example, is configured by the guide body 202 and a transfer body 204.

The guide body 202 has a function of guiding the lower surface and the lower end peripheral surface of the coin C, and in the first example, it is configured by a plate-shaped body having an L-shaped cross-section and being inclined at an angle of approximately 30 degrees, the lower surface of the coin C is guided by a guide flat plate 202P inclined by 30 degrees, and the lower end peripheral surface of the coin C is guided by a guide rail 202L forming a right angle with respect to the lower end of the guide flat plate 202P. In other words, the coin C is configured to move while the lower end peripheral surface is being guided by the guide rail 202L in a state the lower surface is bearing against the guide flat plate 202P. The guide rail 202L is formed to continue to the guide 184. In other words, the peripheral surface of the coin C is guided by the guide 184, and then guided by the guide rail 202L. A passage in which the coin C guided by the guide flat plate 202P and the guide rail 202L moves is a transfer passage 210.

The transfer body 204 will now be described.

The transfer body 204 has a function of moving the coin C along the guide body 202, and in the first example, is configured by an end on the coin identifying device 116 side of the guide body 202, and a belt with teeth 212 wound around a first pulley with teeth 206 and a second pulley with teeth 208 arranged at an end opposite the coin identifying device 116 side in a tensioned state and fixed with a plurality of pushing bodies 214 at a predetermined interval. According to such configuration, the coin C sent out by the rotation blade 182 of the coin identifying device 116 is pushed by the pushing pin 214, and is linearly moved in the horizontal direction of moving away from the coin identifying device 116 with the lower end peripheral surface guided by the guide rail 202L and the lower surface bearing against the guide flat plate 202P.

The denomination coin slot 194 will now be described with reference mainly to FIG. 7.

The denomination coin slot 194 has a function of distributing the coin C determined by the coin identifying device 116 to a specified position according to denomination, and in the first example, is configured by a rectangular denomination opening 216 formed in the guide body 202, specifically, the guide rail 202L, and an open/close body 218 selectively moved to a closed position SP and an opend position UP of substantially closing and opening the rectangular denomination opening 216. In other words, when the open/close body 218 is located at the closed position SP, the coin C is not dropped to the denomination opening 216, whereas when the open/close body 218 is located at the upend position UP, the coin C is dropped to the denomination opening 216 by its own weight. In the first example, the denomination coin slot 194 has, in order from the coin identifying device 116 side, a 10 yen coin slot 1941 for the 10 yen coin 10C, a 100 yen coin slot 19410 for the 100 yen coin 100C, another 100 yen coin slot 19410 for the 100 yen coin 100C, and a 500 yen coin slot 19450 for the 500 yen coin 500C arranged. In other words, in order from the coin identifying device 116 side, a 10 yen opening 2161 for the 10 yen coin 10C, a 100 yen opening 21610 for the 100 yen coin 100C, another 100 yen opening 21610 for the 100 yen coin 100C, and a 500 yen opening 21650 for the 500 yen coin 500C are formed to the same size at a predetermined interval on the guide rail 202L, and a 10 yen open/close body 2181, a 100 yen open/close body 21810, or a 500 yen open/close body 21850 of the corresponding denomination are arranged at the respective openings. The structure of the denomination coin slot 194 is the same for all denominations. The denomination opening 216 can be formed to a guide flat plate 202P. Furthermore, if the 50 yen coin is also a processing target, one of the 100 yen openings 21610 can be used for the 50 yen coin. A method of adding "1" to the 10 yen coin 10C, "10" to the 100 yen coin 100C, and "50" to the 500 yen coin 500C after the reference numeral to distinguish the coins to represent the denomination coin slot by denomination is similarly used in, an electromagnetic actuator 188, the denomination opening 216, the open/close body 218, a drop slot 224, a denomination guiding shoot 226, a coin storage container 238, and the like, to be described later.

The denomination opening 216 will now be described.

In the first example, the denomination opening 216 is used other than when there is a need to describe the opening by denomination.

The denomination opening 216 is an opening where the coin C is dropped to be allocated to the relevant denomination storing and dispensing device 122 in the middle of being moved on the transfer passage 210 in a direction of an arrow A (FIG. 1) and is formed by being cut in a range the guide rail 202L exceeds a width larger than the diameter of the coin C of a substantially maximum diameter and a maximum thickness of the coin C of a few types. In other words, as the first example is provided for the Japanese yen of 10 yen coin 10C to 500 yen coin 500C, the width of the moving direction (direction of arrow A) of the coin C of all the denomination openings 216 is formed to be greater than the diameter of the 500 yen coin 500C and the thickness in an orthogonal direction with respect to the moving direction is formed to be greater than the thickness of the 500 yen coin 500C. When the dropping direction is the orthogonal direction with respect to the surface of the coin C, the size of the denomination opening 216 is formed to be greater than the diameter of the 500 yen coin 500C in both the moving direction and the direction orthogonal to the moving direction of the coin C. When the denomination opening 216 with respect to the coin C for every denomination is fixed, the denomination opening 216 can be formed to a dimension that takes into consideration the diameter and the thickness of the coin C, but the target coin is limited.

The open/close body 218 will now be described with reference to FIG. 7.

In the first example, it is referred to as the open/close body 218 other than when there is a need to describe the body by denomination.

The open/close body 218 has a function of substantially closing or opening the denomination opening 216, and in the first example, is configured by a rod-shaped body or a plate-shaped body extending in the width direction of the denomination opening 216, and selectively moved by the electromagnetic actuator 188 to the closed position SP and the opened position UP. In other words, the open/close body 218 is normally located at the closed position SP (FIG. 1) and the lower end peripheral surface of the coin C is guided when the coin C passes through, but the open/close body 218 is moved to the opend position UP (FIG. 1) by the excitation of the electromagnetic actuator 188 at the timing the coin C of a denomination determined based on the detection by the physical sensor 186 reached the denomination opening 216 of the corresponding denomination, and dropped into the denomination opening 216 of the corresponding denomination.

The return coin slot 196 will now be described with reference mainly to FIGS. 1 and 7.

The return coin slot 196 has a function of receiving the return coin RC determined as fake coin and the like by the coin identifying device 116, and in the first example, is configured by a return opening 216R and a return open/close body 218R, similar to the denomination coin slot 194. In other words, when determined as the fake coin by the coin identifying device 116, such coin is processed as the return coin RC. That is, the return coin RC is moved from the guide 184 to the guide rail 202L, and immediately thereafter, the open/close body 218 of the return opening 216R is moved from the closed position SP to the opend position UP, so that the return coin RC is dropped to the return opening 216R by its own weight and returned to the outlet 136 through a return guiding shoot 222R and a cancel passage body 228, to be described later.

The overflow coin slot 198 will be mainly described below with reference to FIGS. 1 and 7.

When any of the denomination storing and dispensing device 122, to be described later, becomes full, the overflow coin slot 198 has a function of receiving the denomination that became full, and in the first example, is configured by an overflow opening 216*o*. In other words, when determined as the coin C of a predetermined denomination, which is a genuine coin, by the coin identifying device 116, and when the denomination storing and dispensing device 122 corresponding to the relevant denomination is full, the coin becomes the overflow coin OC. The overflow coin OC is pushed by the pushing pin 214 fixed to the transfer body 204 and moved while having the lower end peripheral surface guided by the guide rail 202L, and pushed without being dropped to the denomination coin slot 194 arranged in the middle and dropped to the overflow coin slot 198 (overflow opening 216*o*) at a position farthest from the coin identifying device 116. Furthermore, all the coins C that did not drop to the return coin slot 196 and the denomination coin slot 194 are ultimately dropped to the overflow coin slot 198.

Figure 7:
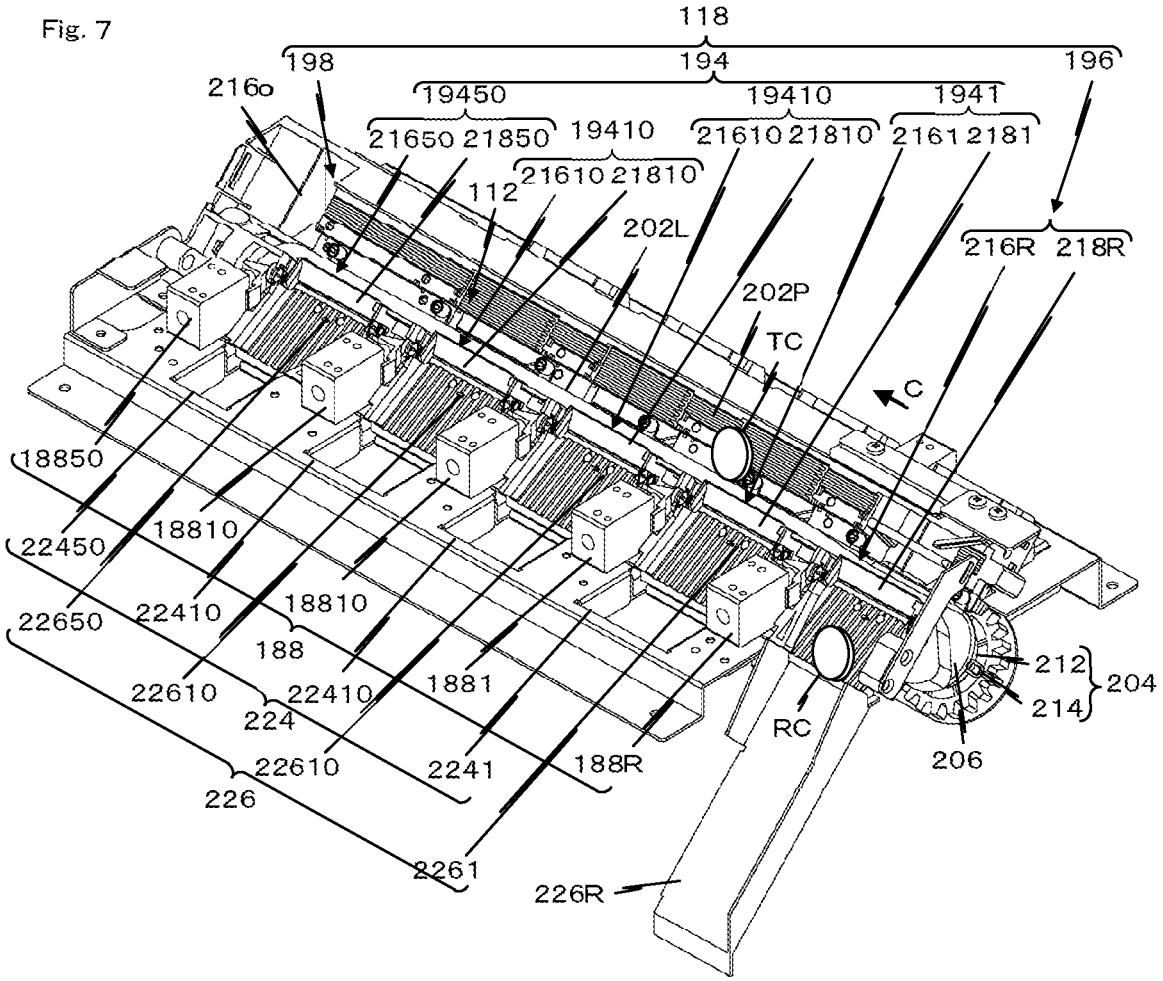
FIG. 7 is a perspective view from an upper left of the front side of a coin transporting and distributing device of the coin recycle device of the first example according to the present invention.
Figure 8:
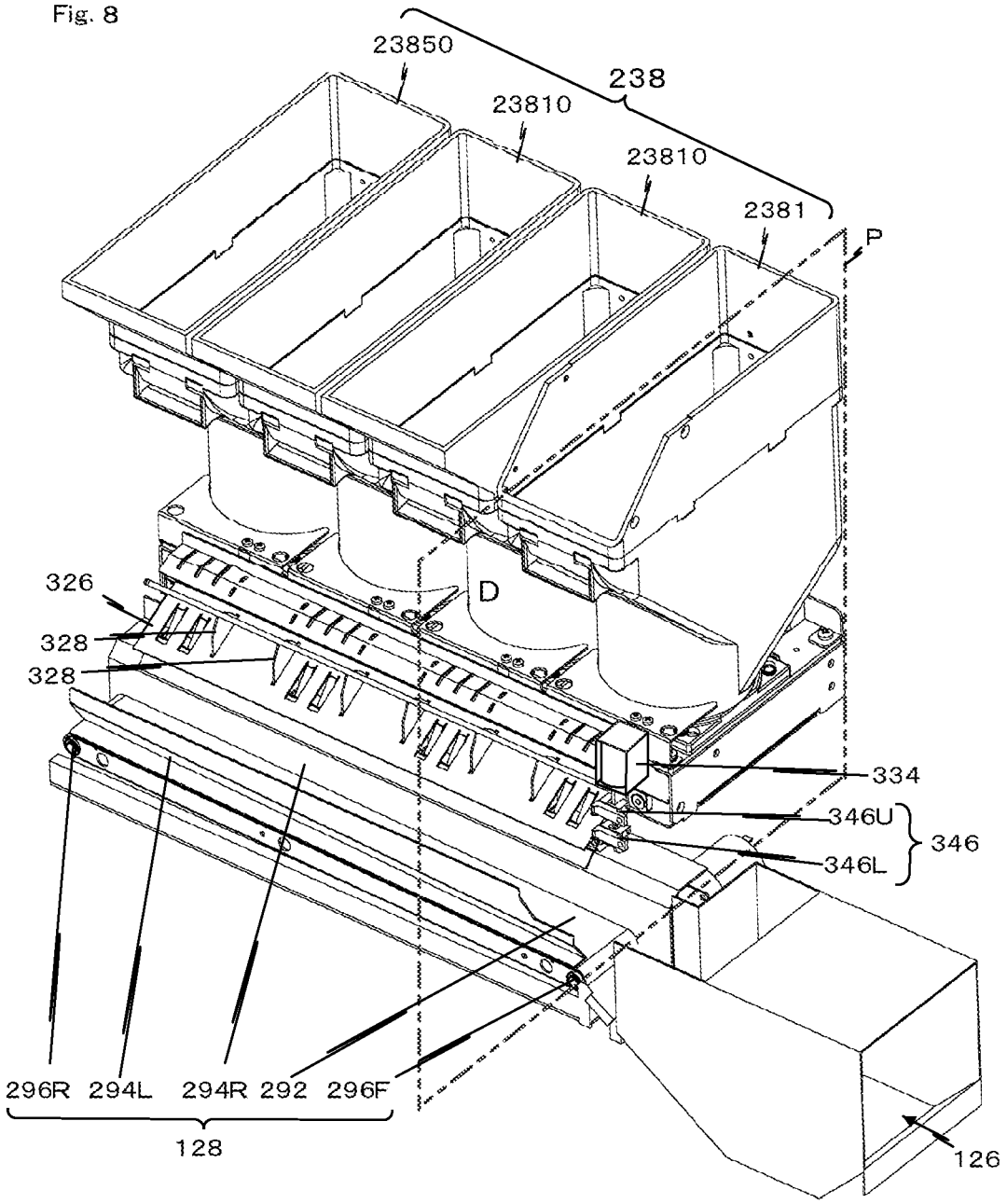
FIG. 8 is a perspective view seen from the upper left of the front side of a denomination storing and dispensing device of the coin recycle device of the first example according to the present invention.

As shown in FIG. 7, the coin transporting and distributing device 118 is preferably unitized due to reasons of assembly property and maintenance. In FIG. 7, same reference numerals are denoted on the same functional portions as FIG. 1, and the description thereof will be omitted. In FIG. 7, the guiding shoot 222 inclined toward the front is arranged on the downstream side of the denomination coin slot 194, so that the coin is dropped from the drop slot 224 connected to the lower end thereof to the denomination storing and dispensing device 122 on the lower side. The return coin slot 196 is configured so that the return coin RC is guided to the tubular cancel passage body 228 (FIG. 3) extending in the up and down direction by the return guiding shoot 226 inclined toward the front side, and guided to the pay-out opening 126, to be described later, by the cancel passage body 228. Furthermore, an upper end of the cancel passage body 228 is expanded and opened to a funnel shape, and is arranged on the lower side of the aligning and sending storage container 176 of the coin aligning and sending device 114. According to such configuration, the aligning and sending storage container 176 is turned with a supporting point at the upper part thereof as the center, so that the coin C remaining in the coin aligning and sending device 114 can be dropped and returned to the pay-out opening 126.

The denomination storing and dispensing device 122 will now be described with reference mainly to FIGS. 1 and 8 to 10.

The denomination storing and dispensing device 122 has a function of holding the coin C allocated by denomination by the coin transporting and distributing device 118 in a bulk state, and sending out the instructed number of coins C to the pay out transporting device 128 one at a time based on the pay-out command PO from the control device 288, to be described later, and in the first example, a so-called coin hopper 232, that is, a 10 yen coin hopper 2321 for a 10 yen coin, a 100 yen coin hopper 23210 for a 100 yen coin, and a 500 yen coin hopper 23250 for a 500 yen coin are used. When a 50 yen coin is used, a 50 yen coin hopper for the 50 yen coin is used. If there is no need to make the explanation of every denomination, the coin hoppers are collectively referred to as a coin hopper 232. The coin hoppers 232 may have different portions in relation to the diameter and the thickness of the denomination being handled but have the same basic configuration, and thus the 10 yen coin hopper 23210 for the 10 yen coin 10C will be representatively described, and the same reference numerals are denoted on the same portions and redundant description will be omitted. The 10 yen coin hopper 23210 includes at least a base 234, an electric motor 236, a coin storage container 238, a coin hopper rotation disc 242, a flicking device 244, a dispensing sensor 246, a coin guide 248, a denomination positioning device 252, and an electric connector 254. Furthermore, the coin hopper 232 is attached to a predetermined position by horizontally inserting the lower surface into the housing 102 along the intermediate bottom 146, and is connected to the electric connector 254. The upper surface of the intermediate bottom 146 is fixed with a rectangular guiding plate 278 (FIG. 14) for guiding each coin hopper 232 corresponding thereto.

Figure 10:
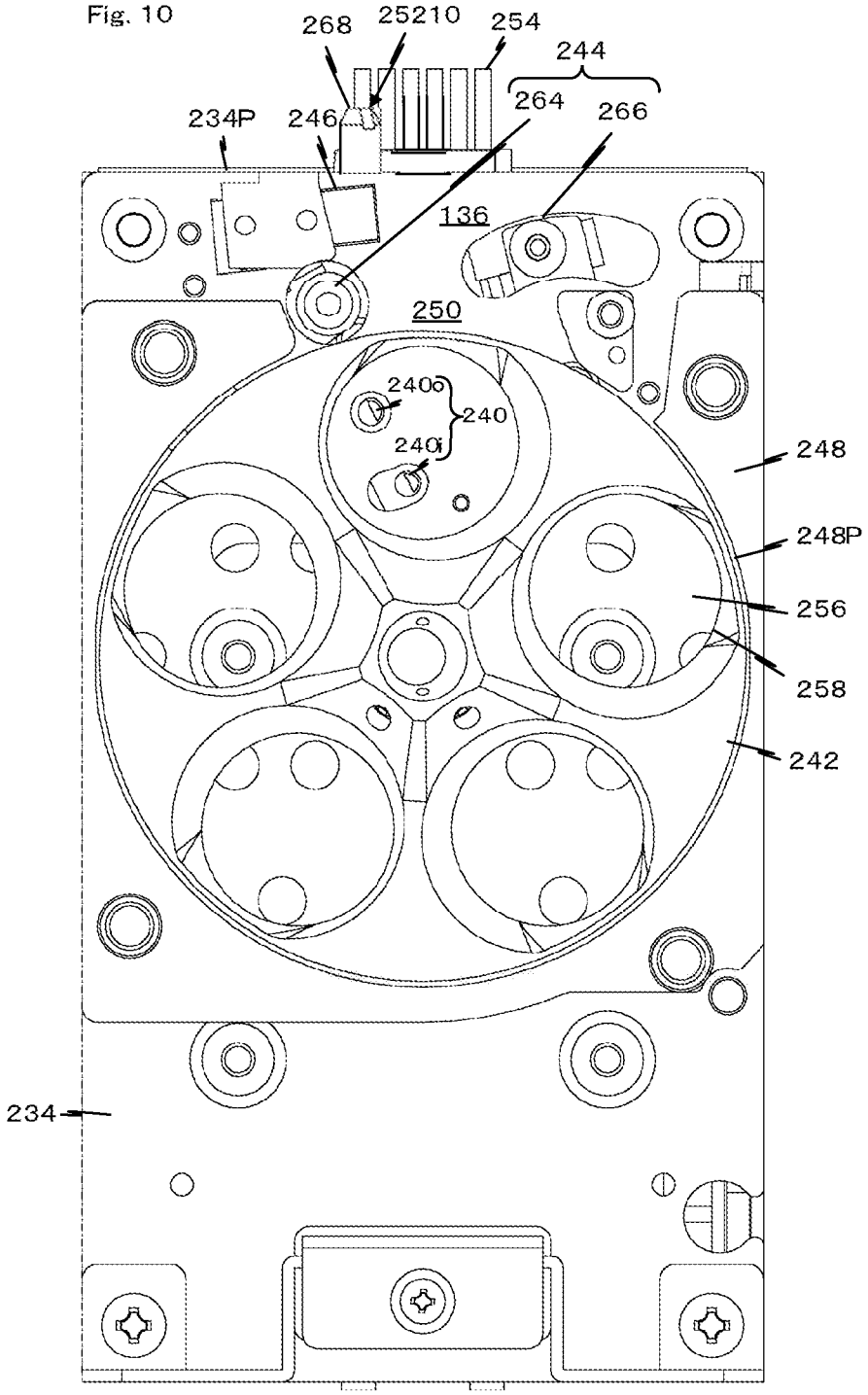
FIG. 10 is a plan view of a main portion of the denomination storing and dispensing device of the coin recycle device of the first example according to the present invention.

First, the base 234 will be described with reference mainly to FIG. 10.

The base 234 has a function of being attached with the electric motor 236, the coin storage container 238, and the like, and in the first example, is formed to a box shape with low height to interiorly arrange the electric motor 236 (FIG. 14) and the like. The upper surface of the base 234 is configured to a sliding surface 256 on which the coin C is slid.

The electric motor 236 will now be described with reference mainly to FIG. 14.

The electric motor 236 has a function of rotating the coin hopper rotation disc 242, to be described later, and is selected from a known DC motor, AC motor, pulse motor, servo motor and the like by comparing the rotation speed, the stop control, the cost, and the like. In the first example, the AC servo motor is used. The rotation of the electric motor 236 is transmitted to the coin hopper rotation disc 242 through a decelerator (not shown).

Figure 9:
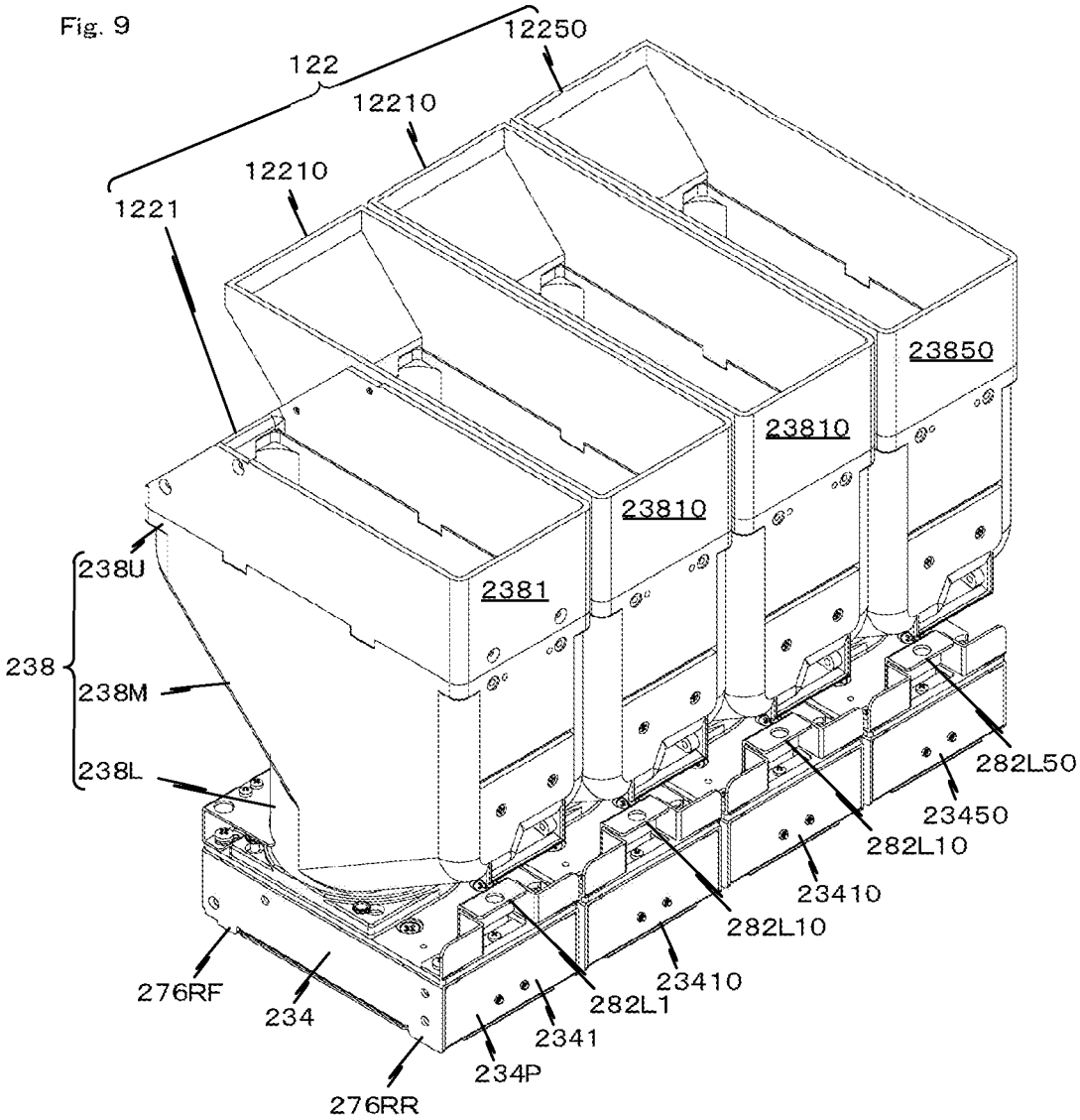
FIG. 9 is a perspective view seen from the upper right of the front side of the denomination storing and dispensing device of the coin recycle device of the first example according to the present invention.

The coin storage container 238 will now be described with reference mainly to FIG. 9.

Coin storage container 238 has a function of storing the coin C dropped from the drop slot 224 by denomination, and in the first example, a horizontal cross-section of the upper part 238U of the coin storage container 238 is formed to a rectangular shape and a horizontal cross-section of a lower part 238L is formed to a circular shape, which cross-sections are smoothly connected by an upward trumpet shaped intermediate portion 238M so as to be formed to vertical tubular shape as a whole.

Next, a regulation pin 240 will be described with reference mainly to FIG. 10.

The regulation pin 240 has a function of guiding the coin C pushed by the coin hopper rotation disc 242, to be described later, to the flicking device 244 side, and in the first example, is configured by two regulation pins, a first regulation pin 240*i* and a second regulation pin 240*o*, projecting out toward the back surface side of the coin hopper rotation disc 242 by a predetermined length from the sliding surface 256. The first regulation pin 240*i* and the second regulation pin 240*o* are generally arrayed in the peripheral direction of the coin hopper rotation disc 242.

The coin hopper rotation disc 242 will now be described with reference mainly to FIG. 10.

The coin hopper rotation disc 242 is arranged at the bottom of the coin storage container 238, and has a function of separating the coin C one at a time and sending out the coin in the peripheral direction by rotating, and in the first example, is formed with a plurality of through-holes 258 at an eccentric position and is configured by a disc body in which a protrusion 262 for pushing the coin C dropped to the through-hole 258 is formed on the back surface. In other words, when the coin hopper rotation disc 242 is rotated in the counterclockwise direction in FIG. 10 by the electric motor 236, the coin C located on the upper side thereof is stirred and dropped to the through-hole 258, so that the lower surface is brought into contact with the sliding surface 256. The coin C is pushed in the same direction by the protrusion 262 on the lower surface of the coin hopper rotation disc 242 while being guided by the inner peripheral surface of the coin guide 248, to be described later, thus reaching the regulation pin 240. The pushed coin C is guided by the regulation pin 240 thus reaching an exit opening 250 located in the peripheral direction of the coin hopper rotation disc 242.

The flicking device 244 will now be described.

The flicking device 244 has a function of further flicking the coin C pushed out in the peripheral direction of the coin hopper rotation disc 242 through the exit opening 250 by the coin hopper rotation disc 242 and the regulation pin 240 in the peripheral direction of the coin hopper rotation disc 242 through the outlet 136, and in the first example, is configured by a fixing roller 264 substantially stationary at a predetermined position and a flicking roller 266 elastically biased to approach the fixing roller 264 at a vicinity of a peripheral edge of the coin hopper rotation disc 242. Normally, the flicking roller 266 is held in a stationary state at an interval smaller than the diameter of the coin C with respect to the fixing roller 264, and when the coin C is pushed out to the exit opening 250 by the coin hopper rotation disc 242, the coin C is pushed in between the fixing roller 264 and the flicking roller 266 and moves the flicking roller 266 away from the fixing roller 264, where immediately after a diameter portion of the coin C is passed between the fixing roller 264 and the flicking roller 266, the coin is flicked out in the peripheral direction of the coin hopper rotation disc 242 and paid out from the outlet 136 by the elastic force applied on the flicking roller 266.

The dispensing sensor 246 will now be described.

The dispensing sensor 246 has a function of detecting the coin C paid out from the outlet 136 by the flicking device 244, and outputting a drawing detection signal CDS, where an electro-optic sensor or an electro-magnetic sensor is used.

The coin guide 248 will now be described with reference mainly to FIG. 10.

The coin guide 248 has a function of guiding the outer side peripheral surface of the coin C moved by the coin hopper rotation disc 242, and in the first example, is formed to a generally C shape by a plate material slightly thicker than the thickness of the coin C and installed on the sliding surface 256. The coin C pushed by the protrusion 262 on the lower surface of the coin hopper rotation disc 242 is guided along an inner surface 284P of the coin guide 248, and then guided by the regulation pin 240 to be introduced to the flicking device 244, and guided to the flicking device 244 through the exit opening 250 of the coin guide 248. A circular portion at the lower part 238L of the coin storage container 238 is arranged immediately above the coin guide 248. Therefore, the coin hopper rotation disc 242 is horizontally rotated at the bottom of the coin storage container 238, and the coin C pushed by the coin hopper rotation disc 242 is moved while having the peripheral surface thereof guided by the inner peripheral surface of the coin guide 248. The denomination storing and dispensing devices 122 all do not need to be arranged in parallel, and at least some devices merely need to be arranged in parallel.

Next, the denomination positioning device 252 will be described.

The denomination positioning device 252 has a function of enabling the denomination storing and dispensing device 122 to be installed only at the position of a predetermined denomination, and in the first example, is configured by a denomination pin 268 projecting out in the horizontal direction from a base front surface 234P on the flicking device 244 side of the base 234, and a denomination receiving hole 274 (FIG. 12) formed in a denomination determining body 272 fixed to the housing 102 side.

Figure 11:
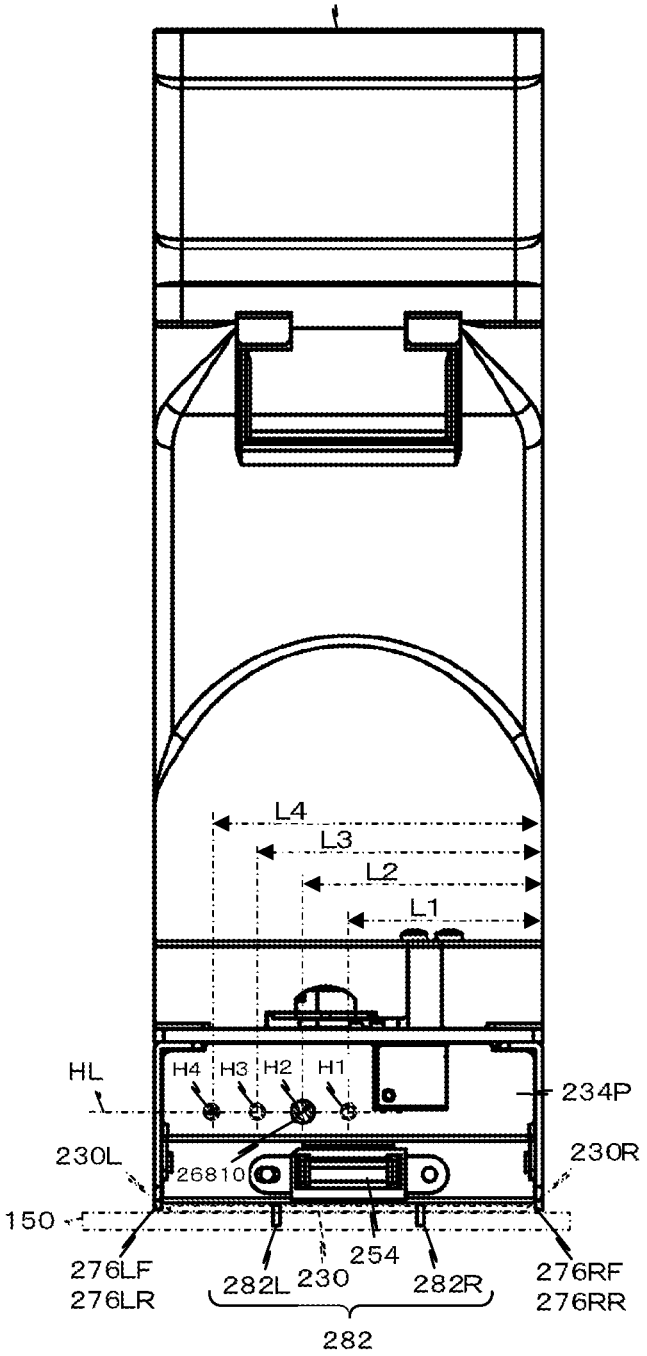
FIG. 11 is a front view of the denomination storing and dispensing device of the coin recycle device of the first example according to the present invention.

First, the denomination pin 268 will be described with reference mainly to FIGS. 10 and 11.

The denomination pin 268 is arranged at different positions for every coin hopper 232 by denomination, and has a distal end formed to a tapered (truncated cone) shape so as to be easily inserted to the denomination receiving hole 274, to be described later.

In the first example, a fixing hole H, and in the first example, a first fixing hole H1, a second fixing hole H2, a third fixing hole H3, and a fourth fixing hole H4, which are four circular holes, are performed at an equal interval on a horizontal line HL in the perpendicularly standing base front surface 234P of the base 234. Specifically, when seen from a side facing the outlet 136 of the coin hopper 232, the first fixing hole H1 is perforated at a position of a distance L1 from a right end of the base 234, the second fixing hole H2 is perforated at a position of a distance L2 from the right end of the base 234, the third fixing hole H3 is perforated at a position of a distance L3 from the right end of the base 234, and the fourth fixing hole H4 is perforated at a position of a distance L4 from the right end of the base 234. The denomination pin 268 is selectively fixed to any one of the first fixing hole H1 to the fourth fixing hole H4. In the first example, the first fixing hole H1 is used for the setting of the 10 yen coin hopper 2321, the second fixing hole H2 is used for the setting of the 100 yen coin hopper 23210, the third fixing hole 113 is used for the setting of the 50 yen coin hopper, and the fourth fixing hole H4 is used for the setting of the 500 yen coin hopper 23250. Therefore, when used as the 10 yen coin hopper 2321, the pin has one end of the denomination pin 268 inserted to the first fixing hole H1 and is fixed to project out laterally in the horizontal direction. In the first example, the denomination pin 268 uses the same pin, and thus to distinguish the denomination pins, description will be made as a 10 yen denomination pin 2681 for 10 yen, a 100 yen denomination pin 26810 for a 100 yen, and a 500 yen denomination pin 26850 for a 500 yen for the sake of convenience. In other words, the 10 yen denomination pin 2685 is fixed to the first fixing hole H1, the 100 yen denomination pin 26810 is fixed to the second fixing hole H2, the 50 yen denomination pin is fixed to the third fixing hole H3, and the 500 yen denomination pin 26850 is fixed to the fourth fixing hole H4. Therefore, the center of the 10 yen denomination pin 2681 is arranged at the position of the distance L1 from the right end of the base 234, the center of the 100 yen denomination pin 26810 is arranged at the position of the distance L2 from the right end of the base 234, the center of the 50 yen denomination pin is arranged at the position of the distance L3 from the right end of the base 234, and the center of the 500 yen denomination pin 26850 is arranged at the position of the distance L4 from the right end of the base 234. The length of the denomination pin 268 is preferably set such that when the coin hopper 232 is inserted to the position of the wrong denomination, the projection of the back end can be clearly recognized than the correctly installed coin hopper 232. In the first example, the stopper 282, to be described later, is set to be at a position not facing a stopper hole 286. In other words, as the distal end of the stopper 282 is located above the guiding plate 278, the coin hopper 232 is in a front inclined state. When the coin hopper 232 is not correctly installed, this can be recognized alone as the coin hopper is in the front inclined state. Other than the circular column shape, the denomination pin 268 may also be formed to a square columnar shape. In this case, the denomination receiving hole 274 also needs to have a similar shape. Furthermore, the denomination corresponding to the denomination pin 268 can be appropriately set.

Figure 12:
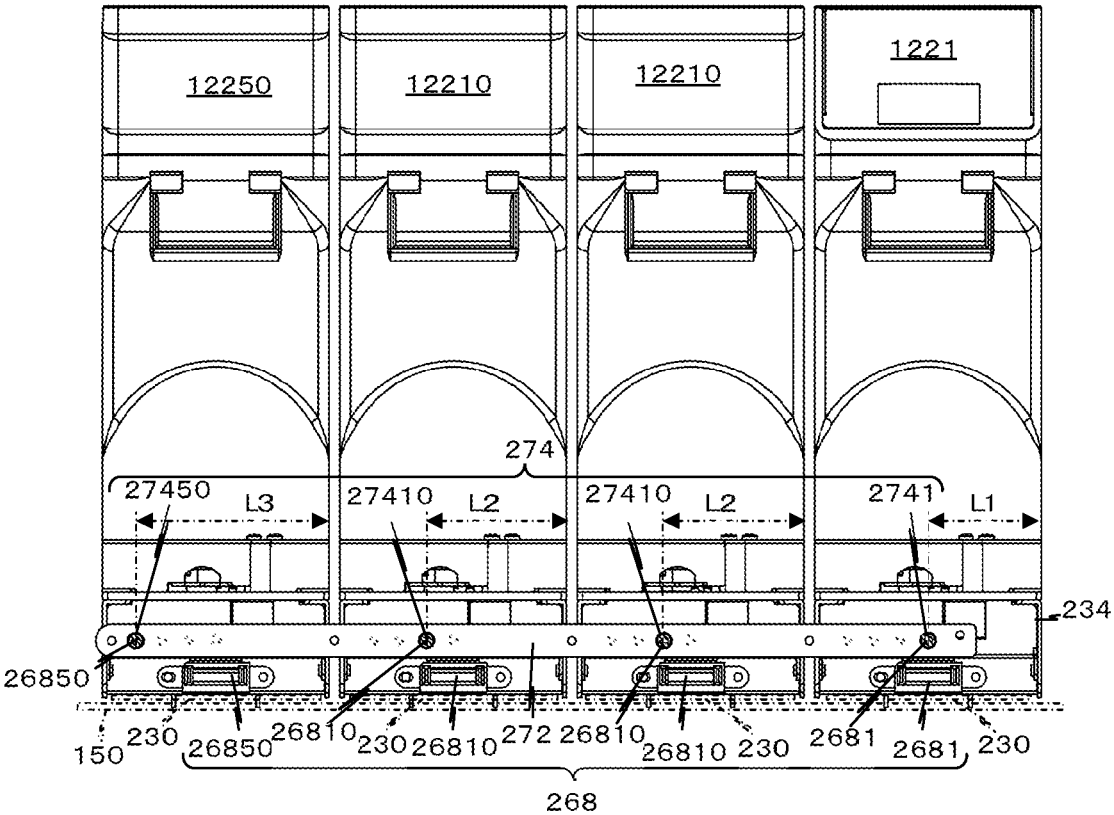
FIG. 12 is a view in which a denomination determining plate is added to the front view of the denomination storing and dispensing device of the coin recycle device of the first example according to the present invention.

The denomination receiving hole 274 will be described with reference to FIG. 12.

The denomination receiving hole 274 is arranged in the denomination determining body 272 fixed to the housing 102 and has a function of receiving the denomination pin 268, that is, a function of being inserted with the denomination pin 268, and in the first example, is arranged at different positions for every denomination, that is, in accordance with the position of the denomination pin 268. Specifically, a 10 yen pin receiving hole 2741 is provided at the position of the distance L1 from the right end of the base 234 of the 10 yen coin hopper 2321 with respect to the 10 yen denomination pin 2681, a 100 yen pin receiving hole 27410 is provided at the position of the distance L2 from the right end of the base 234 of the 100 yen coin hopper 23210 with respect to the 100 yen denomination pin 26810, and a 500 yen pin receiving hole 27450 is provided at the position of the distance L4 from the right end of the base 234 of the 500 yen coin hopper 23250 with respect to the 500 yen denomination pin 26850. Therefore, when the coin hopper 232 of each denomination is inserted to the position of the coin hopper 232 of the relevant denomination, the denomination pin 268 can advance to the corresponding pin receiving hole 274. For example, the 10 yen denomination pin 2681 can be fitted with only the 10 yen pin receiving hole 2741, the 100 yen denomination pin 26810 can be fitted with only the 100 yen pin receiving hole 27410, the 50 yen denomination pin can be fitted with only a 50 yen pin receiving hole, and the 500 yen denomination pin 26850 can be fitted with only the 500 yen denomination pin 26850. Although the illustration is omitted, the 50 yen pin receiving hole is provided at a predetermined distance from the right end of the base 234 of the 50 yen hopper, that is, at the position intermediate of the 100 yen pin receiving hole 27410 and the 500 yen pin receiving hole 27450, where it can be clearly recognized from the description that the 50 yen denomination pin will be fixed to the opposing 50 yen coin hopper side. To prevent mistaken installation of the coin hopper 232, therefore, the denomination storing and dispensing device 122, the positions of the denomination pin 268 and the denomination receiving hole 274 are made common to all the denomination storing and dispensing devices 122, where the respective shapes are differed for every denomination so that the denomination pin 268 can be fitted to the denomination receiving hole 274 in only a specific denomination.

Figure 13:
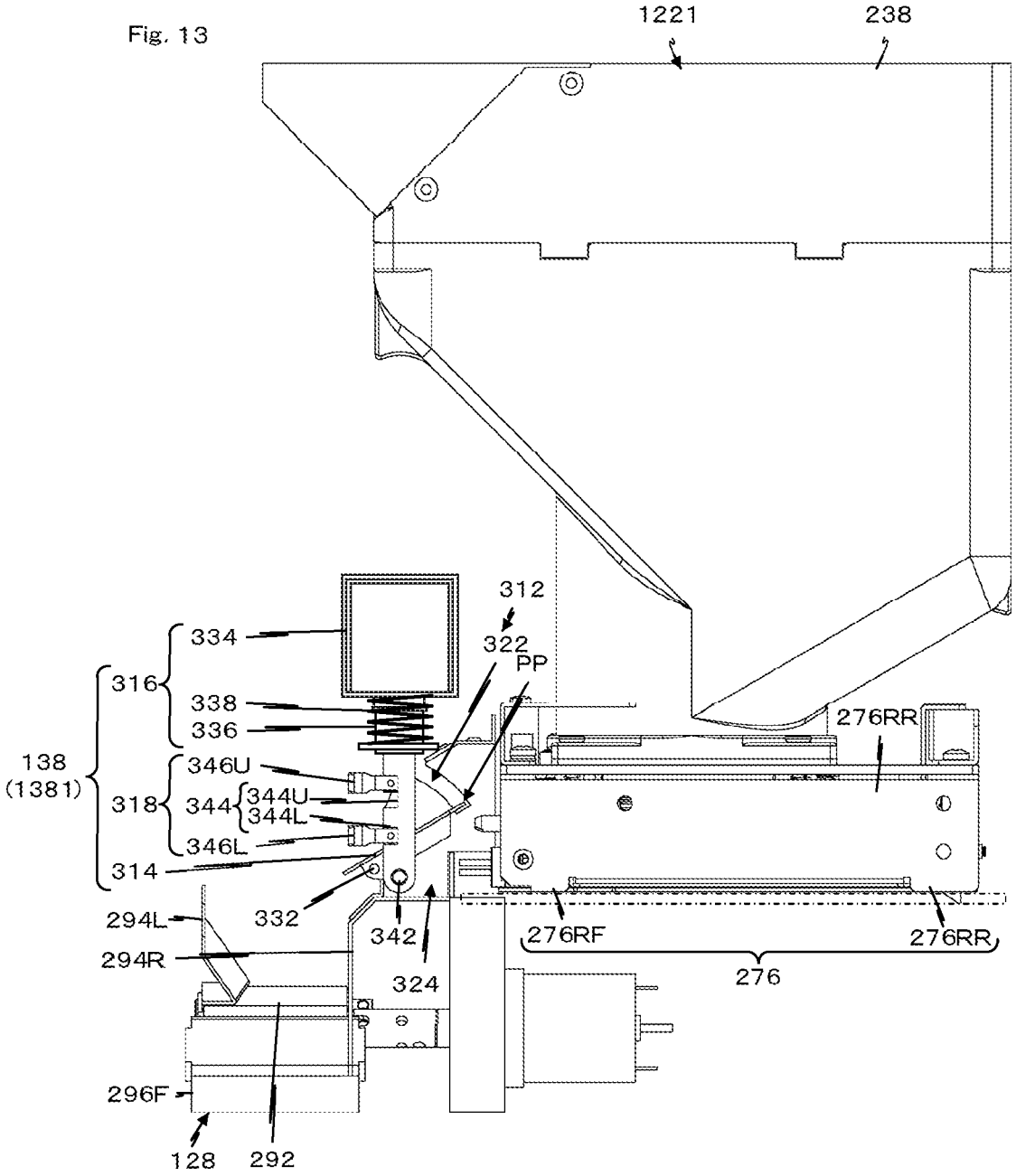
FIG. 13 is a cross-sectional view in a plane P in FIG. 8 of the coin recycle device of the first example according to the present invention (at time of pay-out).

A to-be-guided body 276 will now be described with reference mainly to FIG. 13.

The to-be-guided body 276 has a function of being guided so that the coin hopper 232 advances in a predetermined direction when attaching the denomination storing and dispensing device 122, and thus the coin hopper 232 in the housing 102, and in the first example, is configured by a pair of left and right front left to-be-guided body 276LF, back left to-be-guided body 276LR, front right to-be-guided body 276RF, and back right to-be-guided body 276RR projecting out by a predetermined amount toward a lower side (intermediate bottom 146 side) from the lower surfaces of the front end and the back end of the left end and the right end of the base 234 of each coin hopper 232, and arranged to sandwich the left and right end edges of the rectangular guiding plate 278 (FIG. 11) fixed to the upper surface of the intermediate bottom 146, so that the front left to-be-guided body 276LF and the back left to-be-guided body 276LR are guided by the left end edge 278L of the guiding plate 278, and the front right to-be-guided body 276RF and the back right to-be-guided body 276RR are guided by the right end edge 278R of the guiding plate 278. However, a linear groove may be formed in the intermediate bottom 146, and the to-be-guided body 276 may be projected out into the groove to move along the groove. Furthermore, the to-be-guided body 276 may be a linear groove formed in the base 234 so as to be guided with an upward protrusion projecting out from the intermediate bottom 146 projected out into the groove configuring the to-be-guided body 276. In other words, by simply pushing the coin hopper 232 into the housing 102, the to-be-guided body 276 is guided by the guiding plate 278 and the denomination pin 268 is advanced into the corresponding denomination receiving hole 274, and connected to the electric connector 254, to be described later. Each coin hopper 232 is held at a predetermined position by the stopper 282 shown in FIG. 14 at the relevant position.

The stopper 282 will now be described with reference mainly to FIG. 14.

The stopper 282 has a function of holding the coin hopper 232 attached to a predetermined position at the relevant position, and in the first example, is configured by a pair of left protrusion 282L and right protrusion 282R (FIG. 11) projecting out from the bottom surface of the back part of the base 234. The stopper 282 is arranged to be movable in the up and down direction with respect to the lower surface at the back part of the base 234, and is normally at a lock position FP projecting out by a predetermined amount from the lower surface by an elastic body (not shown). However, the stopper 282 can be moved to an evacuating position LP recessed from the lower surface by pulling up the operation handle 284 to the upper side. In a state the denomination pin 268 is fitted into the denomination receiving hole 274 and the electric connector 254 is corrected fitted, the stopper 282 is advanced to the stopper hole 286 formed in the guiding plate 278 to take the lock position FP, and hence a perpendicularly standing back edge 282B is stationary in the vicinity of the back edge of the stopper hole 286. Therefore, even if the coin hopper 232 attempts to move out in the direction of the arrow B in FIG. 14, the perpendicularly standing back edge 282B gets caught at the back edge of the stopper hole 286 so that the coin hopper 232 cannot be moved out.

The electric connector 254 will now be described with reference mainly to FIG. 14.

The electric connector 254 has a function of connecting or shielding the electric motor 236 of the coin hopper 232 and the dispensing sensor 246 to or from a power supply (not shown) and the control device 288, and in the first example, is configured by a known male connector 254M and a female connector 254F.

Specifically, the female connector 254F is fixed so that a receiving recess is in a horizontally lateral state immediately under the denomination determining body 272 on the housing 102 side, and the male connector 254M is fixed so that a projection is horizontally lateral at a lower part of the front surface of the base 234. A distal end of the male connector 254M is diagonally chamfered so as to be formed to easily enter the receiving recess of the female connector 254F. Thus, a position relationship is set such that when the to-be-guided body 276 of the coin hopper 232 is pushed in the direction of the reverse arrow B in FIG. 14 while being guided by the left end edge 278L and the right end edge 278R of the guiding plate 278, the distal end of the denomination pin 268 advances to the denomination receiving hole 274 immediately after the distal end of the male connector 254M enters the receiving recess of the female connector 254F. The female connector 254F can be fixed to the base 234 side and the male connector 254M can be fixed to the housing 102 side.

Figure 14:
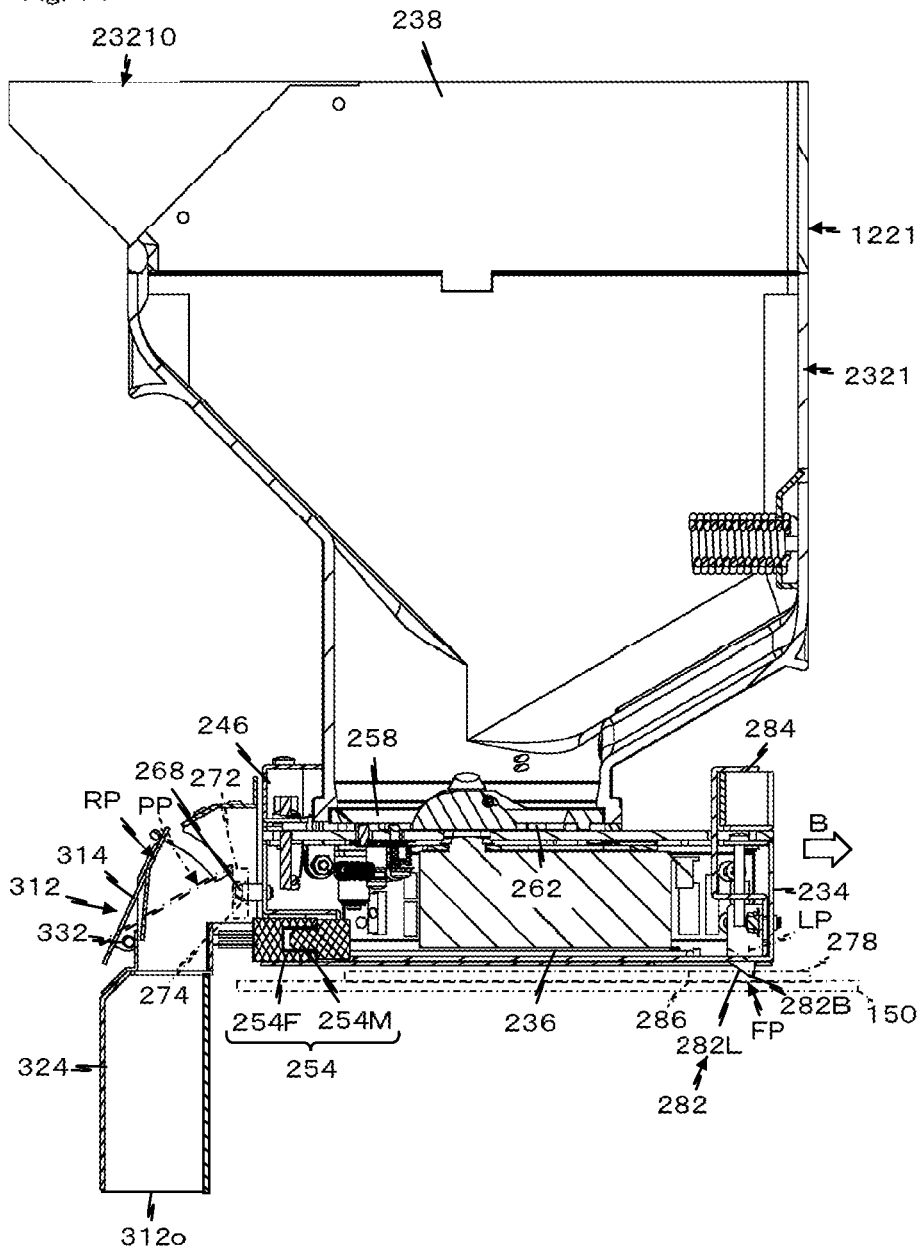
FIG. 14 is a cross-sectional view in the plane P in FIG. 8 of the coin recycle device of the first example according to the present invention (at time of collecting).

When each coin hopper 232 is attached to the housing 102, the to-be-guided body 276 and the guiding plate 278 cooperatively operate so that the lower end of the to-be-guided body 276 is slidably moved on the intermediate bottom 146 to be pushed in a constant direction and in the first example in the direction of the reverse arrow B in FIG. 14. Thus, with respect to the coin hopper 232 inserted to the legitimate denomination position, as described above, the distal end of the male connector 254M is entered to the receiving recess of the female connector 254F, and immediately thereafter, the distal end of the denomination pin 268 is advanced to the denomination receiving hole 274, where in a state in which the end face of the male connector 254M is brought into contact with the end face of the female connector 254F and cannot move in the direction of the reverse arrow B, a state in which the stopper 282 is dropped in the stopper hole 286 becomes the legitimate attachment position. When the coin hopper 232 of different denominations is inserted to different positions of the denomination, the denomination pin 268 cannot advance to the opposing denomination receiving hole 274 as the denomination receiving hole 274 does not exist at the relevant position, whereby the stopper 282 is not dropped in the stopper hole 286 and the back end of the coin hopper 232 is projected out than the other coin hoppers 232. Thus, the fake insertion of the coin hopper 232 can be determined.

The pay out transporting device 128 will now be described with reference mainly to FIG. 3.

The pay out transporting device 128 has a function of transporting the coin C drawn from the denomination storing and dispensing device 122 to the pay-out opening 126, and is configured by at least a flat belt 292 arranged along a row of denomination storing and dispensing devices 122, and in the first example, is configured by the flat belt 292, and a left guide plate 294L and a right guide plate 294R arranged on the left and the right on the upper side of the flat belt 292 to configure a recessed groove having the flat belt 292 as a bottom surface. The flat belt 292 is arranged across a front side roller 296F arranged proximate to the pay-out opening 126 and a back side roller 296R arranged on the back side, the upper surface of which is formed to incline forward toward the pay-out opening 126. Thus, the coin C sent out one at a time from the denomination storing and dispensing device 122, and in the first example, the 10 yen coin hopper 2321, the 100 yen coin hopper 23210, and the 500 yen coin hopper 23250 is transported toward the pay-out opening 126 by the upper surface of the flat belt 292.

The overflow coin storing unit 132 will now be described with reference mainly to FIG. 1.

The overflow coin storing unit 132 has a function of holding the overflow coin OC, and in the first example, is a bag made of fabric that is arranged within a box shaped lower space 102L formed on the lower side of the intermediate bottom 146 of the housing 102 and that has the upper end opened. The fabric includes natural fiber such as cloth, linen, or flax, synthetic fiber such as polyamide fiber, polyester fiber, or aramid fiber, or metal fiber. However, the overflow coin storing unit 132 can be formed to a box shape by metal such as iron, and the like. The lower space 102L is arranged on the front side, and is opened/closed by a door 152 turnably supported with the hinge 154 on one end as a supporting point in FIG. 2. The position of the door 152 is not limited to the front surface side, and may be the side surface, the back surface side, or a plurality of the same. The door 152 can be locked with the locking device 144, to be described later.

The description will now be made with reference to the overflow coin processing device 134.

When the holding amount of the coin C in the denomination storing and dispensing device 122 is full, the overflow coin processing device 134 has a function of receiving and holding the coin C of the relevant denomination, and in the first example, is arranged in the housing 102 and configured by an overflow coin guiding tube 298 arranged in parallel with the denomination storing and dispensing device 122, an overflow coin bag holding tube 302 installed in the lower space 102L the overflow coin storing unit 132, and an overflow coin bag holding ring 306.

The overflow coin guiding tube 298 will now be described with reference mainly to FIG. 1.

Figure 3:
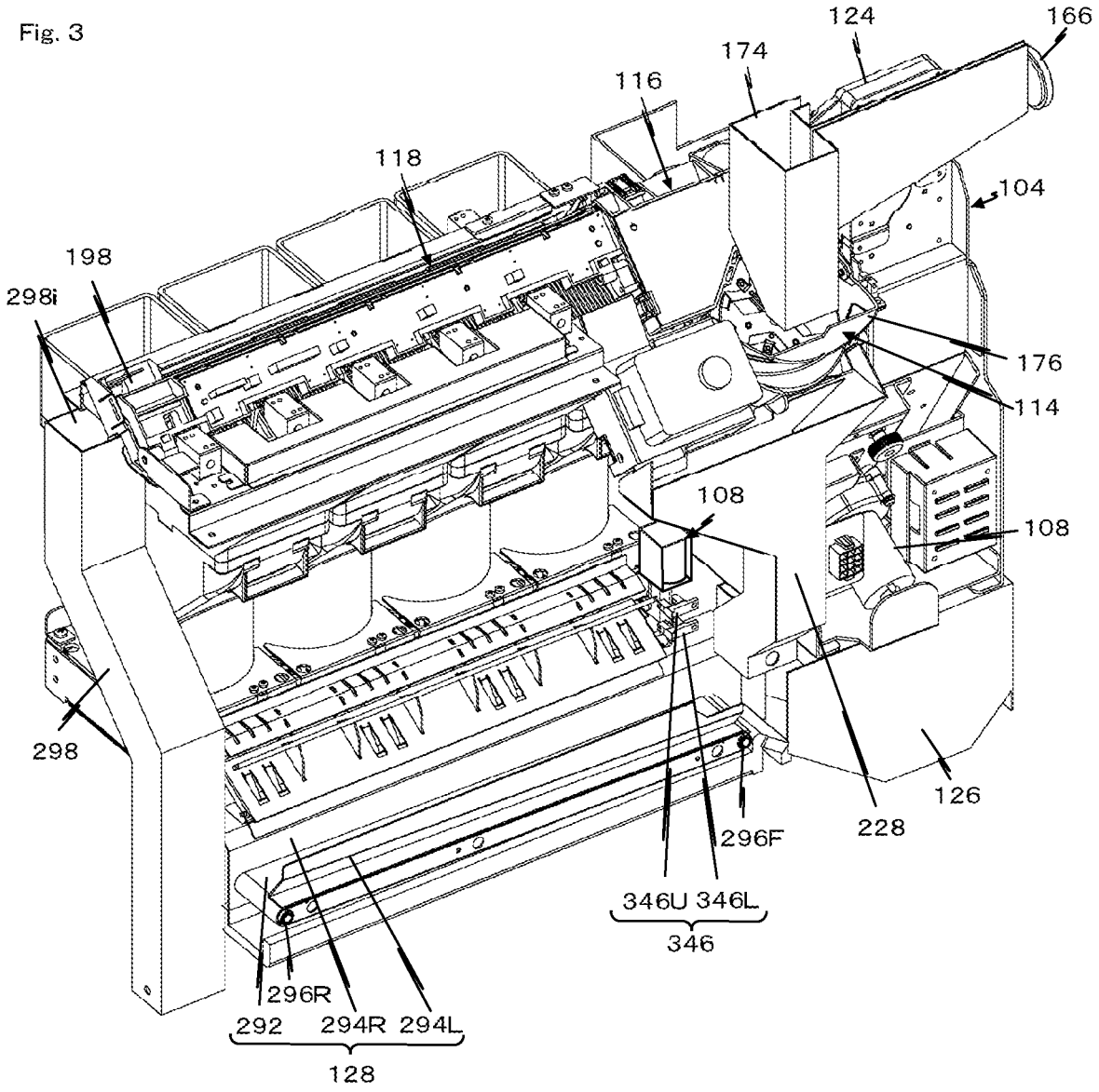
FIG. 3 is a perspective view seen from an upper right of a back side of a main portion of the coin recycle device of the first example according to the present invention.

The overflow coin guiding tube 298 has a function of communicating the overflow coin slot 198 and the overflow coin bag holding tube 302 and guiding the overflow coin OC dropped to the overflow coin slot 198 to the overflow coin bag holding tube 302, and in the first example as shown in FIG. 3, is configured by a tube body having an upper end opening 298*i* immediately under the overflow coin slot 198 and having a lower end opening connected to the upper end of the overflow coin bag holding tube 302. The overflow coin guiding tube 298 is arranged in parallel with the denomination storing and dispensing device 122 at a position farthest from the deposit opening 106. It should be noted that when referring to "arranging in parallel with the denomination storing and dispensing device 122", this includes other than arranging in parallel with respect to all the denomination storing and dispensing device 122, arranging in parallel with respect to some denomination storing and dispensing device 122.

The overflow coin bag holding tube 302 will now be described with reference mainly to FIG. 1.

The overflow coin bag holding tube 302 has a function of holding the upper end opening of the overflow coin storing unit 132 for holding the overflow coin OC, and is a tubular body having a downward trumpet shape, that is, a truncated conical shape in which the upper end is fixed to the intermediate bottom 146 immediately below the lower end of the overflow coin guiding tube 298 and the upper end opening 302*i* is opened to the upper space 102U.

The overflow coin bag holding ring 306 will now be described.

The overflow coin bag holding ring 306 has a function of removably fixing the upper end of the overflow coin storing unit 132 to the overflow coin bag holding tube 302, and in the first example, is an O shaped or a C shaped ring, which inner diameter is greater than the outer diameter of the upper end of the overflow coin bag holding tube 302 and smaller than the outer diameter of the lower end to be fitted to the outer side of the overflow coin bag holding tube 302. Therefore, when attaching the overflow coin storing unit 132 to the overflow coin bag holding tube 302, first the overflow coin bag holding ring 306 is lifted upward to form a gap between the overflow coin bag holding tube 302 and the overflow coin bag holding ring 306. Next, the upper end of the overflow coin storing unit 132, to which the lower end of the overflow coin bag holding tube 302 is placed to be interiorly attached, is pulled through the gap between the overflow coin bag holding ring 306 and the overflow coin bag holding tube 302, and then the overflow coin bag holding ring 306 is shifted toward the lower side to be pushed against the upper end of the overflow coin storing unit 132. Thus, when the overflow coin storing unit 132 is shifted toward the lower side by the weight of the coin C, the overflow coin bag holding ring 306 brought into friction contact therewith is also shifted toward the lower side, whereby the force of pushing the overflow coin storing unit 132 against the overflow coin bag holding tube 302 is further increased, and the overflow coin storing unit 132 is prevented from dropping out from the overflow coin bag holding tube 302. When detaching the overflow coin storing unit 132, the overflow coin bag holding ring 306 is pushed toward the upper side to form a gap between the overflow coin bag holding ring and the overflow coin storing unit 132, so that the upper end of the overflow coin storing unit 132 can be pulled out.

The pay-out distributing device 138 will now be described with reference mainly to FIG. 13.

The pay-out distributing device 138 has a function of guiding the coin C sent out from the denomination storing and dispensing device 122 to a denomination collected coin storing unit 142 different from the pay out transporting device 128 to collect the coin C held in the denomination storing and dispensing device 122 without being paid out from the denomination storing and dispensing device 122 to the pay out transporting device 128, and in the first example, is configured by a denomination guiding passage 312, an distributing body 314, an distributing body moving device 316, and an distributing body position detecting device 318. The pay-out distributing device 138 is common to each denomination storing and dispensing device 122, and thus in the following description, the 10 yen coin distributing body position detecting device 381 shown in FIGS. 13 and 14 will be representatively described.

First, the denomination guiding passage 312 will be described with reference mainly to FIG. 13.

The denomination guiding passage 312 is a passage for guiding the 10 yen coin 10C sent out from the 10 yen denomination storing and dispensing device 1221, and is configured by a pay out passage 322 formed diagonally toward the lower front toward the pay out transporting device 128 side as a whole, and a collecting passage 324 branched from the pay out passage 322 to guide the 10 yen coin 10C flicked by the flicking device 244 of the 10 yen denomination storing and dispensing device 1221 (10 yen coin hopper 2321). The upper side of the denomination guiding passage 312 is configured by one upper side cover plate 326 (FIG. 8) common to each denomination storing and dispensing device 122, where the front and back direction is formed to a tube shape as a whole by being surrounded by a denomination partitioning plate 328 (FIG. 8) extending in the up and down direction. Specifically, the pay out passage 322 is configured when the distributing body 314 is located at the withdrawing position PP (FIG. 14), and the collecting passage 324 is configured when the distributing body 314 is located at the collecting position RP (FIG. 14). The lower end opening 312*o* of the collecting passage 324 is connected to an opening (not shown) formed in the intermediate bottom 146.

Next, the distributing body 314 will be described.

As described above, the distributing body 314 has a function of configuring the pay out passage 322 when located at the pay-out position PP, and configuring the collecting passage 324 when located at the collecting position RP, and in the first example, is a plate shaped body axially supported to be swingable by a predetermined angle with a supporting shaft 332 on the pay out transporting device 128 side as a supporting point, and is opposed to and coupled so as to be integrally movable with each denomination storing and dispensing device 122. When the distributing body 314 is located at the pay-out position PP, the 10 yen coin 10C flicked out from the 10 yen coin hopper is dropped onto the distributing body 314 and slid off the distributing body 314, and thereafter, dropped onto the flat belt 292 of the pay out transporting device 128. In this case, the flat belt 292 is moved to the pay-out opening 126, and thus the withdrawn coin C is sent out to the pay-out opening 126. When the distributing body 314 is located at the collecting position RP, the 10 yen coin 10C comes into collision with the distributing body 314 and is dropped to the lower side through the collecting passage 324 and held in the denomination collected coin storing unit 142 for every denomination.

The distributing body moving device 316 will now be described with reference mainly to FIG. 13.

The distributing body moving device 316 has a function of selectively locating the distributing body 314 at the pay-out position PP or the collecting position RP, and in the first example, is configured by a solenoid 334, a rod body 336 moved by the solenoid 334, an elastic body 338, and a coupling shaft 342. The solenoid 334 is fixed to the housing 102. The rod body 336 is pulled in upward when the solenoid 334 is excited and moved toward the lower side by the elastic force of the elastic body 338 when the solenoid 334 is demagnetized. The lower end of the rod body 336 is axially supported on the distal end side than the supporting shaft 332 of the distributing body 314 by the coupling shaft 342. Since the solenoid 334 is normally not excited, the rod body 336 is projected out toward the lower side by the elastic force of the elastic body 338, and as a result, the distributing body 314 is located at the pay-out position PP. However, when the solenoid 334 is excited, the rod body 336 is pulled up, and thus the distributing body 314 is turned in the counterclockwise direction with the supporting shaft 332 as the center, and moved to the collecting position RP. When the solenoid 334 is demagnetized, the rod body 336 is moved toward the lower side by the elastic body 338, as described above, and thus the distributing body 314 is returned to the pay-out position PP.

Now, the distributing body position detecting device 318 will be described.

The distributing body position detecting device 318 has a function of determining whether the distributing body 314 is at the pay-out position PP or the collecting position RP, and in the first example, is configured by a detection recess 344 formed in the rod body 336 and a sensor 346. Specifically, the detection recess 344 has a rectangular shape and is configured by a first detection recess 344U located on the upper side and a second detection recess 344L located on the lower side, and the sensor 346 is configured by a pair of transmissive first optical sensor 346U and a second optical sensor 346L. According to such configuration, when the distributing body 314 is located at the pay-out position PP, the second optical sensor 346L opposes the second detection recess 344L and thus a projected light from a light projecting unit can be detected by a light receiving unit, whereas the first optical sensor 346U does not oppose the first detection recess 344U and thus the projected light from the light projecting unit is shielded and cannot be detected. On the other hand, when the distributing body 314 is located at the collecting position RP, the second optical sensor 346L does not oppose the second detection recess 344L and thus the projected light from the light projecting unit is shielded and cannot be detected, whereas the first optical sensor 346U opposes the first detection recess 344U and thus the projected light from the light projecting unit can be detected by the light receiving unit. Therefore, whether the distributing body 314 is at the pay-out position PP or the collecting position RP, or is abnormal can be determined based on the output state of the signals from the first optical sensor 346U and the second optical sensor 346L.

Next, the denomination collected coin storing unit 142 will be described with reference mainly to FIG. 1.

The denomination collected coin storing unit 142 has a function of holding the coin C sent out from the denomination storing and dispensing device 122 and guided to the collecting passage 324 by the distributing body 314, and in the first example, is configured by a 10 yen collected coin storing unit 1421, a 100 yen collected coin storing unit 14210, and a 500 yen collected coin storing unit 14250. The configuration of such denomination collected coin storing unit 142 is the same as the overflow coin storing unit 132 described above, and thus the same reference numeral is denoted on the same component and the redundant description will be omitted. The upper end opening of the overflow coin bag holding tube 302 is arranged on an extension of the lower end opening of the collecting passage 324. Therefore, the coin C sent out from each denomination storing and dispensing device 122 is guided to the collecting passage 324 by the distributing body 314, and stored in the 10 yen collected coin storing unit 1421, the 100 yen collected coin storing unit 14210, or the 500 yen collected coin storing unit 14250 through the overflow coin bag holding tube 302. This process is, for example, carried out when collecting all the coins C in each denomination storing and dispensing device 122. The denomination collected coin storing unit 142 can be installed in a denomination collected coin storing chamber (not shown) arranged separate from the overflow coin storing chamber 130. However, as shown in the first example, as the denomination collected coin storing unit 142 is arranged with the overflow coin storing chamber 130, an advantage in that manufacturing is inexpensive can be obtained.

The locking device 144 will now be described with reference to FIG. 13.

The locking device 144 has a function of locking at least the overflow coin storing unit 132, and therefore, the door 152 for opening and closing the lower space 102L, and in the first example, locks the door 152 to the housing 102. The locking device 144 may be a known locking device. In other words, at least the overflow coin storing unit 132 arranged in the lower space 102L cannot be collected unless the locking device 144 is unlocked, and in the first example, the denomination collected coin storing unit 142 cannot be collected. When referring to locking the overflow coin storing unit 132, this includes both locking the overflow coin storing unit 132 itself and locking the overflow coin storing chamber 130 in which the overflow coin storing unit 132 is arranged. The first example is an example of the latter case, and a second example described later is an example of the former case. Furthermore, when the coin recycle device 100 not including the locking device is arranged in the housing including the locking device 144, or when installed in a chamber including the locking device or a building including the locking device, such locking devices correspond to the locking device 144 described in the present invention.

Figure 15:
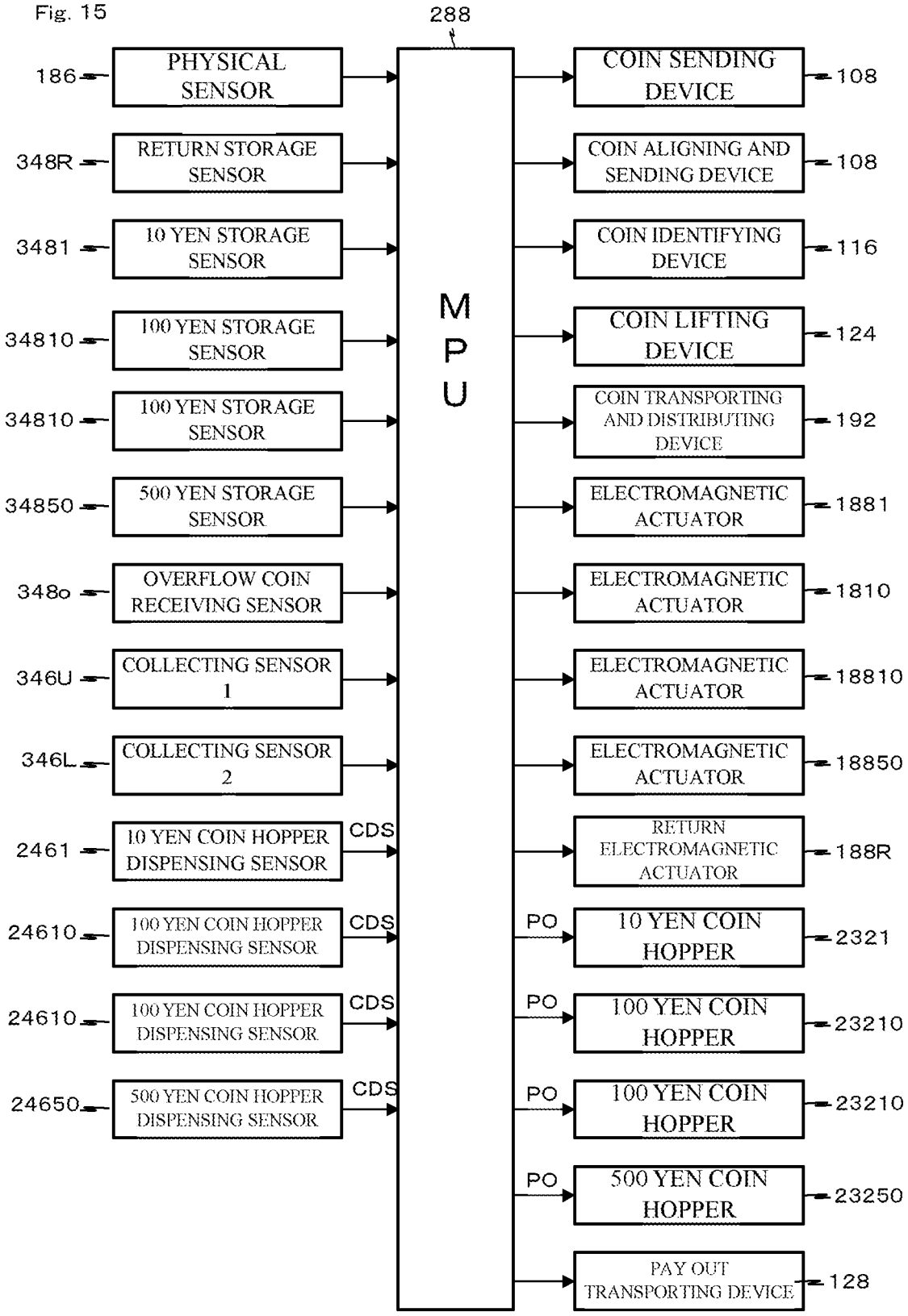
FIG. 15 is a control block diagram of the coin recycle device of the first example according to the present invention.

The control device 288 will now be described with reference to FIG. 15.

The control device 288 has a function of carrying out a predetermined process based on signals from the physical sensor 186, the first optical sensor 346U, the second optical sensor 346L, a denomination storage sensor 348 described later, and the like, and a predetermined program, and causing the coin transporting and distributing device 118, the pay out transporting device 128, the actuator 188, and the like to carry out a predetermined operation at a predetermined timing, and in the first example, is configured by a microcomputer.

The storage sensor 348 will now be described with reference mainly to FIG. 1.

The storage sensor 348 has a function of detecting the coin C dropped from the denomination coin slot 194, therefore, the denomination opening 216, and in the first example, is individually arranged at a position of detecting the coin C dropped from the denomination coin slot 194 to the coin storage container 238. In FIG. 1, it is displayed with a reference number in which a number of a tens unit or a hundreds unit and a tens unit of the denomination is combined after the reference numeral 348. Furthermore, the coin OC dropped from the overflow coin slot 198 to the overflow coin processing device 134 is also detected by the overflow storage sensor 348*o*, and the coin RC dropped to the return coin slot 196 is also detected by the return sensor 348R.

According to such configuration, genuine/fake and the denomination of the coin C inserted to the deposit opening 106 or the one-coin inserting slot 164 are determined based on the information of the coin C acquired by the physical sensor 186. In the case of the fake coin, the open/close body 218 is moved to the opend position UP in the return coin slot 196, and the coin is dropped onto the return guiding shoot 226R and returned to the pay-out opening 126 through the cancel passage body 228. The return coin RC is detected by the return sensor 348R immediately after dropping from the return coin slot 196, and such return is determined in the control device 288. Even if the respective denomination is dropped to the denomination coin slot 194, therefore, the 10 yen opening 2161, the 100 yen opening 21610, or the 500 yen opening 21650, the 10 storage sensor 3481, the 100 yen storage sensor 34810, or the 500 yen storage sensor 34850 of each denomination detects the coin C immediately after being dropped, and outputs a detection signal DS. Whether the coin C of the relevant denomination dropped to the denomination opening 216 of the relevant denomination is determined based on the timing the coin C is detected by the physical sensor 186 and the detection signal DS. Furthermore, the overflow coin OC dropped to the overflow coin slot 198 is detected by the overflow storage sensor 348*o*, and the dropping of the coin to the overflow coin processing device 134 is determined based on the detection signal DS. Therefore, in the control device 288, the holding number of the overflow coin storing unit 132 can be grasped by arithmetic processing. Thus, determination can be made when the number of overflow coins OC in the overflow coin storing unit 132 becomes closer to the overflow number, and a warning can be output based on the determination. Furthermore, when the overflow number set in advance is reached, the operation of the coin recycle device 100 can be stopped. In the denomination storing and dispensing device 122, when the held coin C is paid out, this is detected by the dispensing sensor 246. Therefore, in the denomination storing and dispensing device 122, the held number for every denomination can be grasped by arithmetic processing from the received number from the storage sensor 348 and the paid out number from the dispensing sensor 246. When the held number in the denomination storing and dispensing device 122 of a predetermined denomination reaches the overflow number set in advance based on the information on the held number for every denomination, even the relevant denomination is passed without being dropped to the denomination coin slot 194 without moving the open/close body 218 in the denomination coin slot 194, and can be dropped to the overflow coin slot 198 located at the most back portion.

The operation of the coin recycle device 100 of the first example will now be described.

First, when a great number of coins C are inserted in a bulk state to the deposit opening 106, the coins are dropped into the storage container 162 of the coin sending device 108. When the presence of the coin C is detected by a sensor (not shown) in the coin sending device 108, an electric motor (not shown) is activated to separate the coins C one by one and send out the coin to the coin lifting device 124. In the coin lifting device 124, the received coin C is transported to the upper side one by one, and dropped into the aligning and sending storage container 176 of the coin aligning and sending device 114. In the coin aligning and sending device 114 that detected the coin C in the aligning and sending storage container 176, the electric motor (not shown) is activated, the rotating body 178 is rotated, and the coins C in the aligning and sending storage container 176 are separated one by one and provided to the coin identifying device 116. In the coin identifying device 116, the rotation blade 182 is rotated to move the coin C one by one along the guide 184, and the physical property of the coin C is acquired by the physical sensor 186. The coin C sent out from the coin identifying device 116 is provided to the transfer body 204 of the coin transporting and distributing device 118. The transfer body 204 in the coin transporting and distributing device 118 is cooperatively operated with the coin identifying device 116, and belt with teeth 212, therefore, the pushing pin 214 is moved at a predetermined speed in the leftward direction from the right as shown with an arrow C in FIG. 7. Therefore, the coin C provided to the transfer body 204 is pushed by the pushing pin 214 while having the lower surface guided by the guide flat plate 202P and the lower end peripheral surface guided by the guide rail 202L and horizontally and linearly moved in the direction of moving away from the coin identifying device 116. In such moving process, determination on the genuine coin or the fake coin is made based on the physical property acquired by the physical sensor 186, where if determination is made as fake coin, the return open/close body 218R of the return coin slot 196 is moved by the actuator 188 from the position configuring the guide rail 202L to the closed position SP in accordance with the timing of the passing of the return coin RC with respect to the return coin RC. The return coin RC is thereby returned to the pay-out opening 126. In the first example, the 10 yen coin 10C, the 100 yen coin 100C, and the 500 yen coin 500C are stored, and thus the 50 yen coin and the 5 yen coin, even if such coins are genuine coins TC, are returned as the return coin RC.

The coin C determined as the genuine coin TC is determined with denomination, wherein the course of being moved while being guided by the guide rail 202L, the open/close body 218 in the denomination opening 216 with respect to the corresponding denomination is moved so that the coin is slidably dropped to the denomination guiding shoot 226, and thereafter, dropped and held in the coin storage container 238 of the denomination storing and dispensing device 122 (coin hopper 232) through the drop slot 224 by denomination. In other words, in the case of the 10 yen coin 10C, the 10 yen open/close body 2181 of the 10 yen opening 2161 is moved from the closed position SP to the opend position UP, so that the 10 yen coin 10C is slid on the denomination guiding shoot 2261 and dropped to the drop slot 2241, and then dropped into and held in the coin storage container 238 of the 10 yen coin hopper 2321. In the case of the 100 yen coin 100C, the 100 yen open/close body 21810 of the 100 yen opening 21610 is moved, so that the 100 yen coin 100C is slid on the denomination guiding shoot 22610 and dropped to the drop slot 22410, and then dropped into and held in the coin storage container 238 of the 100 yen coin hopper 23210. In the first example, two 100 yen coin hoppers 23210 are arranged, and hence in which 100 yen coin hopper 23210 to hold the coin is incorporated in a program in advance. For example, the coins may be alternately allocated or may be set to be allocated, after one of the 100 yen coin hoppers 23210 becomes full, to the other 100 yen coin hopper 23210. In the case of the 500 yen coin 500C, the 500 yen open/close body 21850 of the 500 yen opening 21650 is moved, so that the 500 yen coin 500C is slid on the denomination guiding shoot 22650 and dropped to the drop slot 22450, and then dropped into and held in the coin storage container 238 of the 100 yen coin hopper 23250. The number of held coins C for every denomination is detected by the storage sensor 348, as described above. Therefore, when the coin holding amount of one of the denomination storing and dispensing device 122 becomes full, the open/close body 218 in the denomination opening 216 of the relevant denomination is not moved and thus the coin is not dropped but is moved along the guide rail 202L, and ultimately dropped to the overflow coin slot 198. The coin C dropped to the overflow coin slot 198 is dropped while being guided by the overflow coin guiding tube 298, and held in the overflow coin storing unit 132 through the overflow coin bag holding tube 302. Therefore, even if the denomination storing and dispensing device 122 becomes full, the overflow coin OC is held in the overflow coin storing unit 132, and thus the process by the coin recycle device 100 can be continued. Furthermore, since the overflow coin OC can be held irrespective of the sending out of the coin C by the denomination storing and dispensing device 122, the coin process will not be interrupted. In order to pay out a predetermined amount of coin C to the pay-out opening 126, a predetermined number of coins C are sent out from the denomination storing and dispensing device 122 of the corresponding denomination. For example, when paying out 990 yen, one 500 yen 500C is sent from the 500 yen coin hopper 23250, four 100 yen coins 100C are sent out from the 100 coin hopper 23210, and 9 10 yen coins 10C are sent out from the 10 yen coin hopper 2321 to the pay out transporting device 128. When collecting the coin C of the overflow coin storing unit 132, the locking device 114 is opened to open the door 152, and then the overflow coin storing unit 132 is taken out, and a new overflow coin storing unit 132 is attached to the overflow coin bag holding tube 302 with the overflow coin bag holding ring 306. Then, the door 152 is fastened, and then locked with the locking device 114.

Second Example

A second example of the present invention will now be described with reference to FIGS. 16 and 17.

The second example is an example in which the overflow coin storing unit 132 is installed exterior to the housing 102. The overflow coin storing unit 132 of the second example will be described as a second overflow coin storing unit 1322 to distinguish from the first example, where the same reference numerals are denoted on the same portions as the first example, and the description thereof will be omitted.

Figure 16:
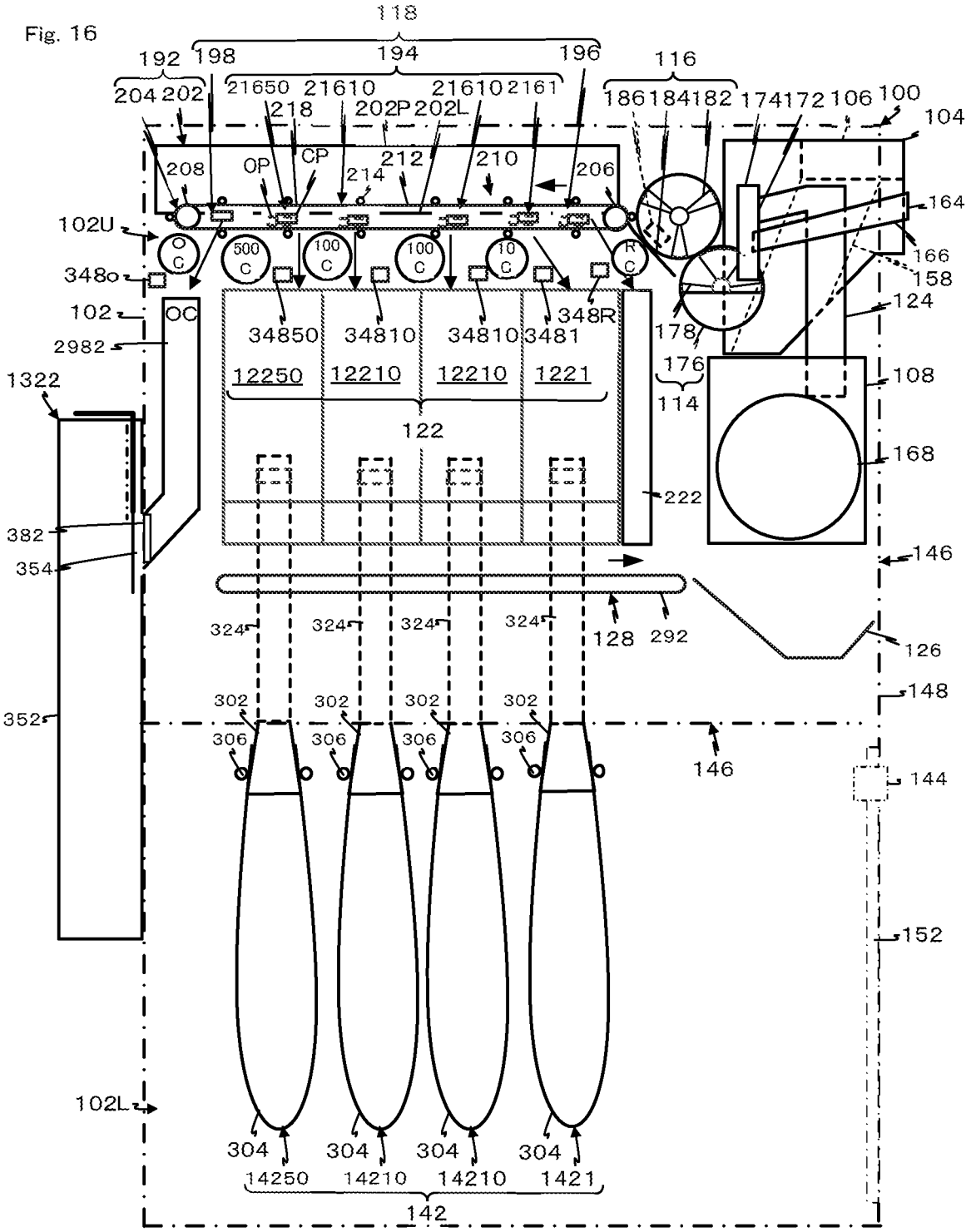
FIG. 16 is an explanatory view of an outline of a coin recycle device of a second example according to the present invention.
Figure 17A:
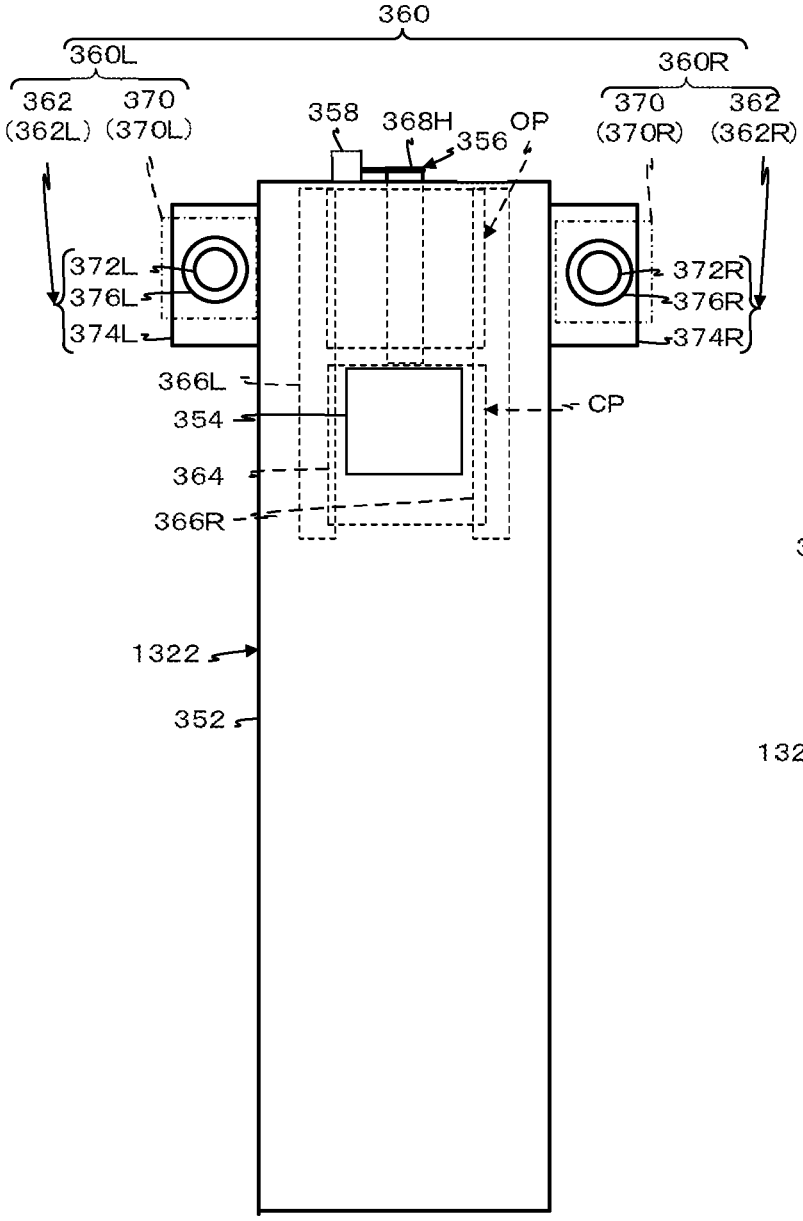
FIGS. 17A and 17B show an overflow coin storage box of the coin recycle device of the second example according to the present invention, where
Figure 17B:
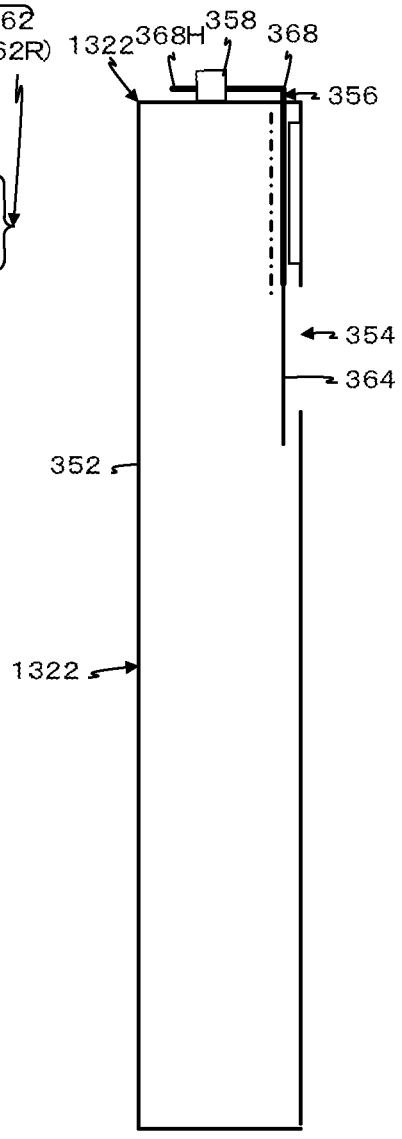

The second overflow coin storing unit 1322 of the second example has a function of receiving the overflow coin OC at the exterior or the coin recycle device 100 and to be able to be detached and transported, and is formed to a box shape and removably fixed on the rear surface side of the housing 102, as shown in FIG. 16. The second overflow coin storing unit 1322 is a safe box 352, which safe box 352 includes a receiving opening 354, a receiving opening open/close unit 356, a receiving opening open/close unit locking unit 358, and a second locking device 360.

First, the safe box 352 will be described.

The safe box 352 has a function of receiving the overflow coin OC and being held in a burglar proof manner, and in the second example, is formed to a box shape with a metal, and receives and holds the overflow coin OC in an interior space and has the receiving opening 354 for receiving the overflow coin OC formed at one part of the wall surface, where when detaching the safe box 352 from the coin recycle device 100, the receiving opening open/close unit 356 for opening the receiving opening 354 is arranged, and furthermore, the receiving opening open/close unit locking unit 358 for locking the receiving opening open/close unit 356 is annexed, and moreover, a safe box fixing unit 362 for locking the safe box 352 to the housing 102 is arranged on the exterior.

The receiving opening 354 will now be described.

The receiving opening 354 has a function of passing the overflow coin OC dropped to the overflow coin slot 198, and dropped while being guided by the overflow coin guiding tube 298, therefore, the second overflow coin guiding tube 2982, and in the second example, is an opening formed to a rectangular shape in the wall surface of the safe box 352.

The receiving opening open/close unit 356 will now be described.

The receiving opening open/close unit 356 has a function of closing and opening the receiving opening 354, as necessary, and in the first example, is configured by a rectangular plate shaped shielding body 364 movable arranged in the safe box 352 and formed greater than the receiving opening 354, and a left guiding body 366L for guiding the left end and a right guiding body 366R for guiding the right end to move the left and right ends of the shielding body 364 along the wall surface of the safe box 352. According to such structure, the shielding body 364 can be moved in the up and down direction along the side wall configuring the safe box 352 while having the left end guided by the left guiding body 366L and the right end guided by the right guiding body 366R, where the receiving opening 354 is closed when the shielding body 364 is present at the closed positino CP opposing the receiving opening 354, and the shielding body does not oppose the receiving opening 354 when the shielding body is located at the upend positino OP moved to the upper side. The shielding body 364 includes a horizontal portion 368H bent at right angle having a lower end of a plate shaped operation body 368 connected to the upper end, the upper end of the operation body 368 projecting out to the exterior of the safe box 352. The shielding body 364 is remained at the position opposing the receiving opening 354 by locking the horizontal portion 368H to the upper surface of the safe box 352.

The receiving opening open/close unit locking unit 358 will now be described.

The receiving opening open/close unit locking unit 358 has a function of locking with the shielding body 364 held at the closed position CP, and in the second example, is fixed to the upper surface of the safe box 352, holds the horizontal portion 368H at the closed positino CP of the shielding body 364, and locks the holding state. According to such configuration, the shielding body 364 is held and locked at the closed positino CP by the receiving opening open/close unit locking unit 358. This locking is carried out before detaching the safe box 352 from the coin recycle device 100. After attaching the safe box 352 to the coin recycle device 100, the receiving opening open/close unit locking unit 358 is unlocked, and the shielding body 364 is moved to the opend positino OP to be able to receive the overflow coin OC.

The second locking device 360 will now be described.

The second locking device 360 has a function of fixing the safe box 352 to the housing 102 by locking and detaching the safe box 352 from the housing 102 by unlocking, and in the second example, is configured by a left second locking device 360L and a right second locking device 360R configured by a safe box fixing unit 362 and a safe box locking unit 370. Therefore, the safe box fixing unit 362 also includes the left safe box fixing unit 362L and the right safe box fixing unit 362R, and the safe box locking unit 370 also includes the left safe box locking unit 370L and the right safe box locking unit 370R. Other than when there is a need to make the description specifying left and right in particular, the description will be made using the safe box fixing unit 362 and the safe box locking unit 370.

The safe box fixing unit 362 will now be described.

The safe box fixing unit 362 has a function of attaching the safe box 352 to the coin recycle device 100, and in the second example, configured by a left attachment rod 372L and a right attachment rod 372R laterally and horizontally projecting out from the housing 102. The safe box 352 is attached to the housing 102 by locking the left attachment rod 372L to a left attachment hole 376L formed in a left tab 374L and the right attachment rod 372R to a right attachment hole 376R formed in a right tab 374R projecting out from the side at the upper part of the safe box 352.

The safe box locking unit 370 will now be described.

The safe box locking unit 370 has a function of locking the safe box 352 to the housing 102 so as not to be detached from the coin recycle device 100, and in the second example, has a structure of being locked by the left locking device 370L or the right locking device 370R so that the left tab 374L is not detached from the left attachment rod 372L and the right tab 374R is not detached from the right attachment rod 372R in the safe box fixing unit 362. Furthermore, only one of the left locking device 370L or the right locking device 370R may be provided.

The second overflow coin guiding tube 2982 will now be described.

The second overflow coin guiding tube 2982 has the same function as the overflow coin guiding tube 298 in the first example, and is juxtaposed with the denomination storing and dispensing device 122, but since the safe box 352 serving as the second overflow coin storing unit 1322 is arranged exterior to the housing 102, the lower end of the overflow coin guiding tube 298 is bent in the side wall direction, and the overflow coin guiding tube lower end opening 382 at the lower end is arranged on the outer surface of the housing 102 on the lower side than the denomination storing and dispensing device 122 at the rear surface of the housing 102.

In the second example, the safe box 352 for holding the overflow coin OC is arranged on the outer side of the housing 102, and thus as shown in FIG. 16, the overflow coin guiding tube lower end opening 382 at the lower end of the second overflow coin guiding tube 2982 is opened to the outer surface of the coin recycle device 100. The overflow coin guiding tube lower end opening 382 opposes the receiving opening 354 when the safe box 352 is fixed to the housing 102, and is connected in a substantially gap-free state. Thus, the overflow coin OC dropped to the overflow coin slot 198 is held in the safe box 352 on the lower side of the denomination storing and dispensing device 122 through the second overflow coin guiding tube 2982. When the safe box 352 is arranged exterior to the housing 102 as in the second example, the door 152 does not need to be opened or closed, and thus the second overflow coin storing unit 1322 can be easily removably attached to the coin recycle device 100.

Third Example

A third example will now be described with reference to FIGS. 18 to 20.

The third example is an example of arranging a collecting coin determining device 380 that determines the coin WC to be collected, and guiding the coin WC to be collected by the overflow coin guiding tube 298 based on a collecting coin signal WCS. The coin WC to be collected includes fake coins FC, coins that are contaminated (dirt, deformation, scratches, color change, rust etc.) even if the coins are genuine coins TC, old coins, and the like, and refers to all or some of such coins. The fake coin FC is sometimes distinguished between the fake coin to be collected WFC and the fake coin FC that does not need to be collected. The fake coin to be collected WFC is a fake coin FC having a high possibility of being mistakenly recognized as the genuine coin TC, and the fake coin FC that can be clearly determined as the fake coin FC has a low necessity of being collected but may be collected. In the third example, the collecting coin determining device 380 includes a to-be-collected fake coin determining device 392 and a to-be-collected genuine coin determining device 394.

The to-be-collected fake coin determining device 392 has a function of determining the fake coin FC to be collected and preferably determines the fake coin by comparing with a reference value of the fake coin FC acquired in advance. In the third example, all the fake coins FC are set as the fake coin to be collected WFC.

The to-be-collected genuine coin determining device 394 has a function of determining the genuine coin to be collected WTC, and a coin that is a genuine coin TC but is desirably not circulated in the market, for example, the old coin is set. In this case, not all old coins but some old coins may be set. Only one of the to-be-collected fake coin determining device 392 or the to-be-collected genuine coin determining device 394 may be provided.

Figure 18:
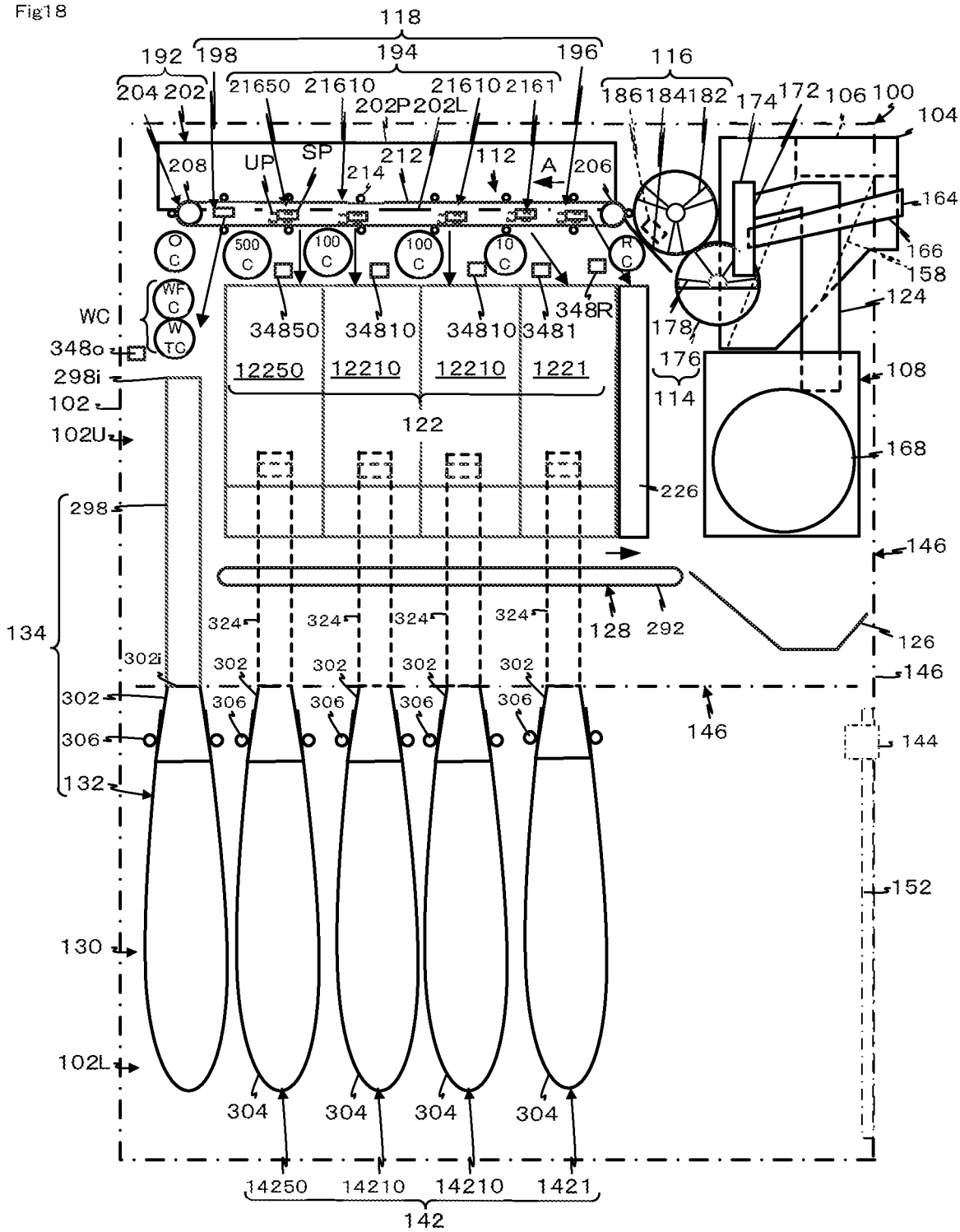
FIG. 18 is an explanatory view of an outline of a coin recycle device of a third example according to the present invention.
Figure 19:
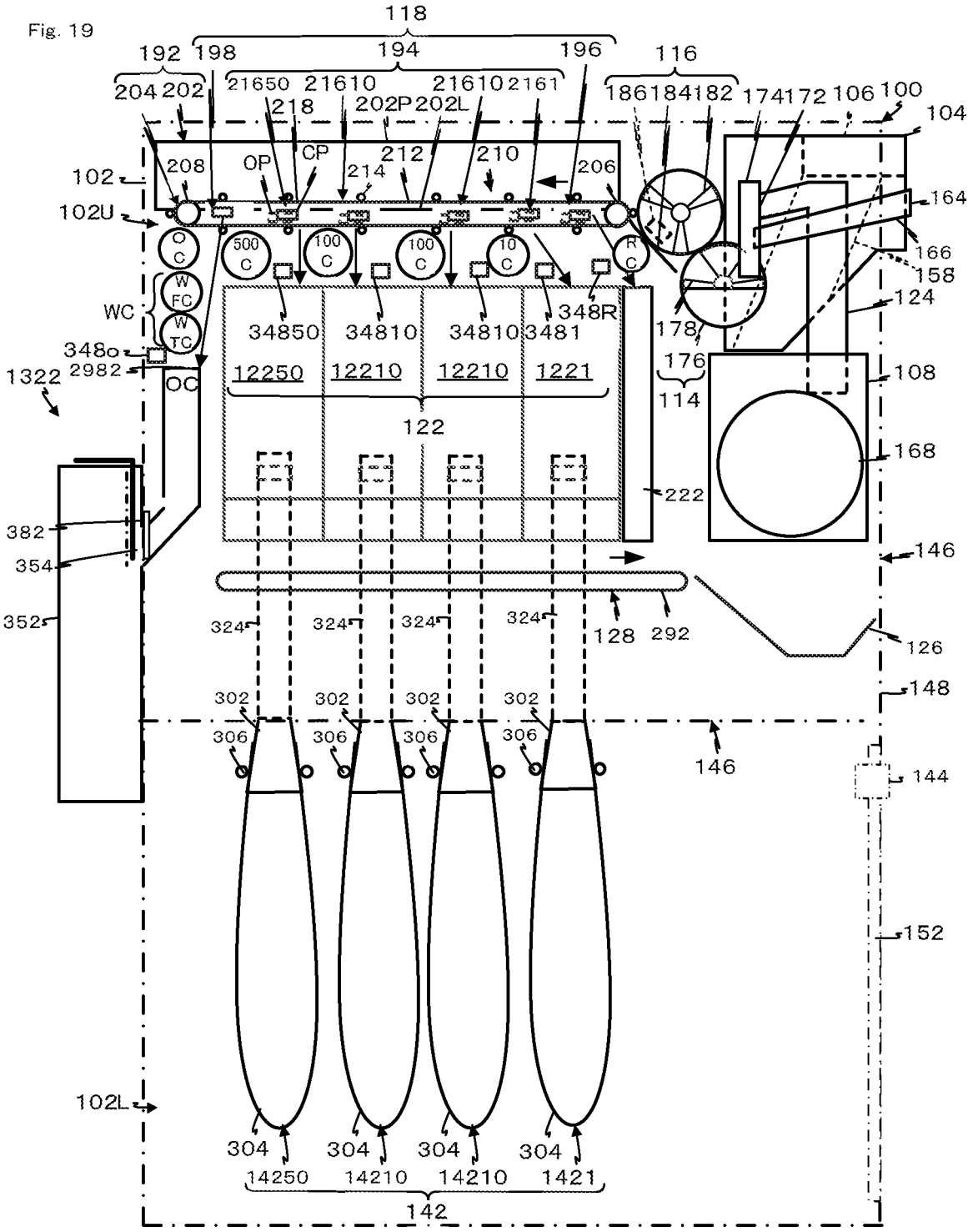
FIG. 19 is an explanatory view of an outline of the coin recycle device of the third example according to the present invention.
Figure 20:
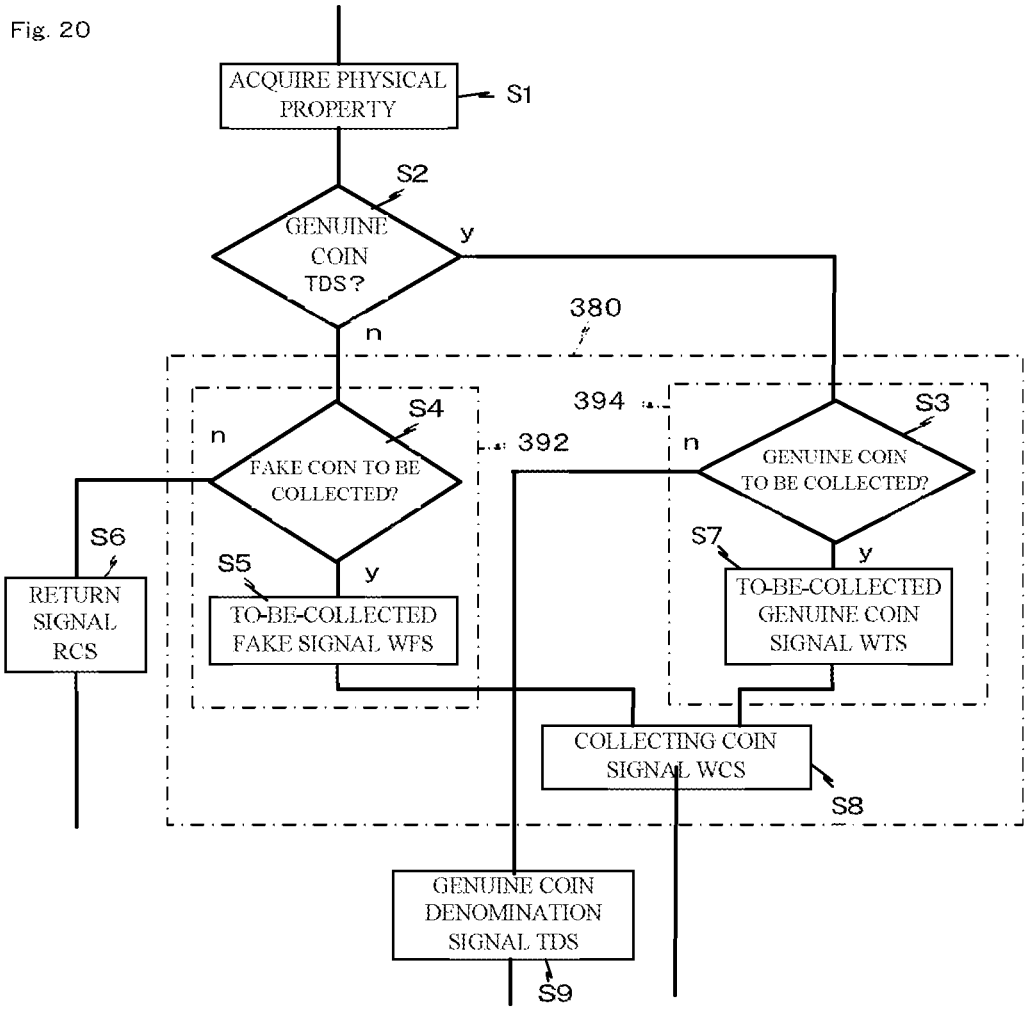
FIG. 20 is a flowchart describing an operation of the coin recycle device of the third example according to the present invention.

FIG. 18 is a view in which the fake coin to be collected WFC and the genuine coin to be collected WTC are added as the coin WC to be collected to FIG. 1, and FIG. 19 is a view in which t e fake coin to be collected WFC and the genuine coin to be collected WTC are added as the coin WC to be collected to FIG. 16.

In the third example, the mechanical configuration can be realized by adding a program corresponding to the collecting coin determining device 380 to the program in the control device 288 without making changes to the first or second example. In other words, the fake coin FC determined as the fake coin to be collected WFC by the to-be-collected fake coin determining device 392 is pushed and transported by the pushing pin 214 of the transfer body 204 while having the lower surface guided by the guide flat plate 202P and the lower end peripheral surface guided by the guide rail 202L in the coin transporting and distributing device 118 without being dropped to the return coin slot 196, and then dropped to the overflow coin slot 198. The fake coin to be collected WFC that dropped into the overflow coin slot 198 is dropped while being guided by the overflow coin guiding tube 298 and held in the overflow coin storing unit 132 through the overflow coin bag holding tube 302 when the configuration of the first example is adopted. When the configuration of the second example is adopted, the coin is held in the safe box 352 installed downstream through the second overflow coin guiding tube 2982. In the third example, the safe box 352 is arranged on the lower side than the denomination storing and dispensing device 122. However, the position of the safe box 352 is not limited to the lower side. In the first and second examples, if the determination in the collecting coin determining device 380 is the fake coin FC, the return open/close body 218R of the return coin slot 196 is moved by the actuator 188 from the closed position SP to the opend position UP configuring the guide rail 202L in accordance with the timing of the passing of the return coin RC and the return coin RC is returned to the return coin slot 196. However, in the third example, if determined as the fake coin to be collected WFC in the collecting coin determining device 380, the coin is assumed as the fake coin to be collected WFC and not as the return coin RC and the collecting coin signal WCS is output and provided to the coin transporting and distributing device 118, and the return open/close bloody 218R of the return coin slot 196 is remained at the closed position SP configuring the guide rail 202L. Furthermore, since the open/close body 218 in the denomination opening 216 is also maintained at the closed position SP, the fake coin FC serving as the fake coin to be collected WFC is not dropped but is moved along the guide rail 202L and ultimately dropped to the overflow coin slot 198. Thus, the fake coin to be collected WFC is dropped while being guided by the overflow coin guiding tube 298, and held in the overflow coin storing unit 132 through the overflow coin bag holding tube 302 or held in the safe box 352 through the second overflow coin guiding tube 2982.

Furthermore, similar to the overflow coin OC, the genuine coin to be collected WTC, for example, the old coin FOC is ultimately dropped to the overflow coin slot 198 as the open/close body 218 in the corresponding denomination opening 216 is maintained at the closed position SP. Thus, the genuine coin to be collected WTC is dropped while being guided by the overflow coin guiding tube 298, and held in the overflow coin storing unit 132 through the overflow coin bag holding tube 302 or held in the safe box 352 through the second overflow coin guiding tube 2982. The genuine coin TC that is a genuine coin TC but is not a receiving target, or 50 yen coin and 5 yen coin in the third example are returned to the return coin slot 196 as the return coin RC.

In the third example, the collecting coin determining device 380 is configured by a program in the control device 288, and thus will be described with reference to the flowchart shown in FIG. 20.

First, the physical property is acquired by the physical sensor 186 in step S1, and the process proceeds to step S2.

When compared with the genuine coin determination reference value TDS set as the receiving coin, and determined as the genuine coin TC to be received in step S2, the process proceeds to S3, and when determined as the genuine coin TC which physical property is not to be received or as the fake coin FC deviating from the genuine coin denomination reference value TDS, the process proceeds to step S4.

When compared with the reference value of the fake coin to be collected WFC and determined as the fake coin to be collected WFC in step S4, the process proceeds to step S5, and when determined as not the fake coin FC to be collected, the process proceeds to step S6.

After the collecting fake coin signal WFS is output in step S5, the process proceeds to step S8.

The return signal RCS is output in step S6. When the return signal RCS is output, the return open/close body 218R of the return coin slot 196 is moved by the actuator 188 from the closed position SP to the opend position UP configuring the guide rail 202L, and returned to the return coin slot 196.

In step S3, whether the genuine coin to be collected WTC or the old coin is determined. When determined as the genuine coin to be collected WTC (old coin), the process proceeds to step S7, and when determined as the genuine coin TC not to be collected, that is, the genuine coin TC to be held in the denomination storing and dispensing device 122, the process proceeds to step S9.

In step S9, the genuine coin determination signal TDS is output. When the genuine coin denomination signal TDS is output, the return open/close body 218R of the return coin slot 196 maintains the closed position SP configuring the guide rail 202L, and thus after passing the return open/close body 218R, it is dropped in the denomination coin slot 194 of the relevant denomination by moving the open/close body of the determined denomination to the opend position UP.

In step S8, the collecting coin signal WCS is output. In other words, in the third example, when determined as the fake coin to be collected WFC and the collecting fake coin signal WFS is output, and when determined as the genuine coin to be collected WTC and the collecting genuine coin signal WTS is output, the collecting coin signal WCS is output. When the collecting coin signal WCS is output, the return open/close body 218R of the return coin slot 196 is maintained at the closed position SP configuring the guide rail 202L, and the open/close body 218 for every denomination is also maintained at the closed position SP, so that the fake coin to be collected WFC and the genuine coin to be collected WTC are dropped into the overflow coin slot 198 after passing the return open/close body 218R. Therefore, in view of the operation of each step, in the third example, the to-be-collected fake coin determining device 392 is configured by steps S4 and S5, and the to-be-collected genuine coin determining device 394 is configured by steps S3 and S7. Furthermore, in the third example, the collecting coin determining device 380 is configured to include step S8. Step S5 or S7 may be omitted, and the collecting coin signal WCS may be output in step S8 upon receiving the signal output in step S3 or step S4.

In the third example, as the overflow coin OC, the fake coin WFC to be collected, and the genuine coin to be collected WTC coexist in the overflow coin storing unit 132 or the safe box 352, the coins are of course collected from the overflow coin storing unit 132 or the safe box 352, and then again need to be determined and sorted on the genuine/fake and denomination of the coin. Therefore, when the fake coin to be collected WFC or the genuine coin to be collected WTC are taken in, the warning that such coins are taken in is preferably issued by display, sound, or the like when collecting the overflow coin storing unit 132 or the safe box 352.

Fourth Example

Figure 21:
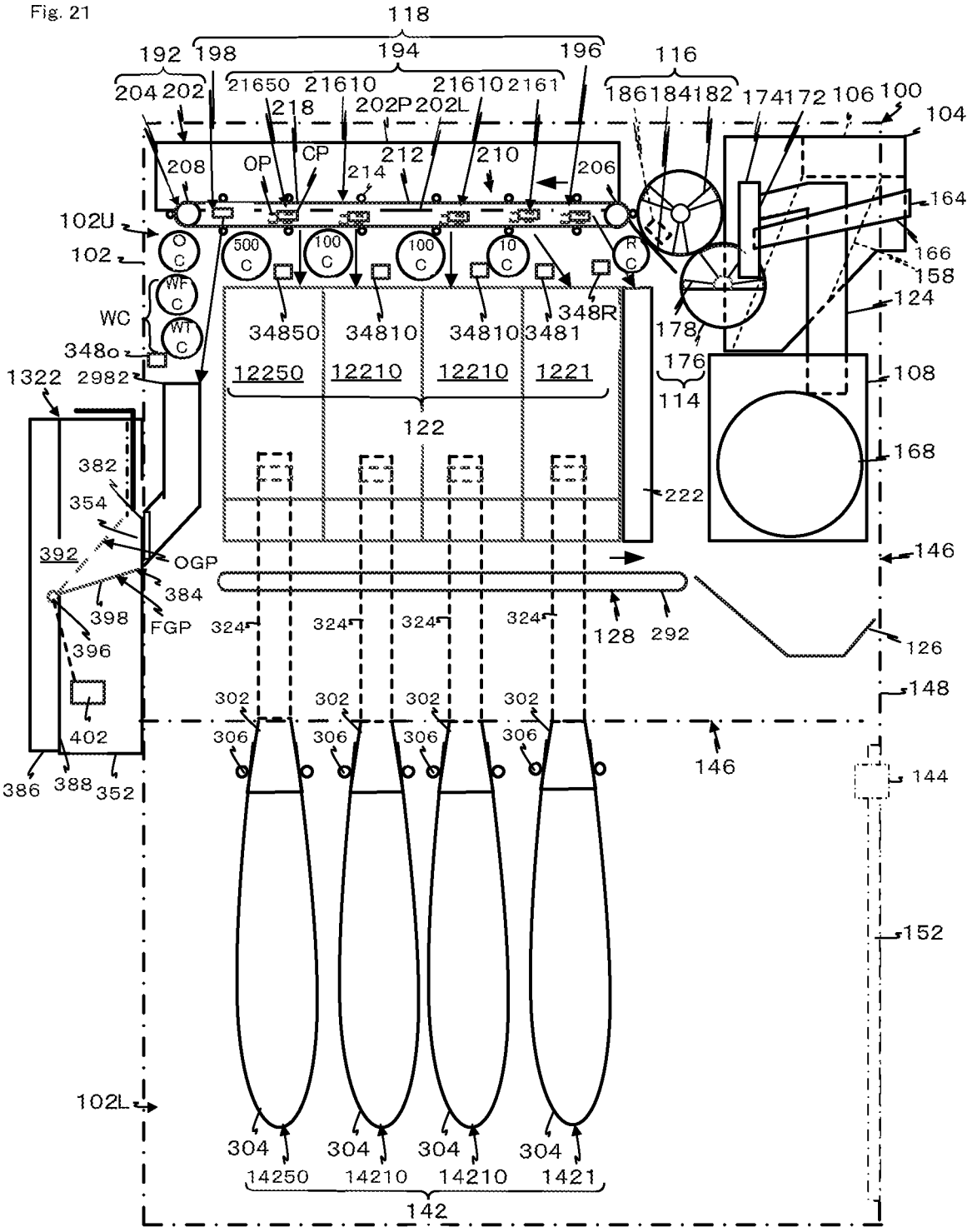
FIG. 21 is an explanatory view of an outline of a coin recycle device of a fourth example according to the present invention.

A fourth example will now be described with reference to FIG. 21.

The fourth example is an example in which a fake coin distributing device 384 for distributing the overflow coin OC and the fake coin FC is arranged in front of the entrance of the safe box 352 at the downstream of the second overflow coin guiding tube 2982 shown in FIG. 19 in the third example to allocate the overflow coin OC and the fake coin FC. In other words, the fake coin distributing device 384 is functioned based on the fake coin signal FCS, so that the fake coin FC dropped from the overflow coin guiding tube lower end opening 382 of the second overflow coin guiding tube 2982 is allocated and stored in a fake coin storing unit 386. Thus, the overflow coin OC is held in the safe box 352 and the fake coin FC is held in the fake coin storing unit 386, whereby the task of resorting after collecting becomes unnecessary, and the convenience enhances. The genuine coin to be collected WTC is processed similar to the overflow coin OC.

The fourth example will now be described with reference to FIG. 21. As described above, the fourth example is an example in which the fake coin distributing device 384 and the fake coin storing unit 386 are added to the third example shown in FIG. 19.

First, the fake coin storing unit 386 will be described.

The fake coin storing unit 386 has a function of holding the received fake coin to be collected WFC, and in the fourth example, is a box body made of metal arranged adjacent to the safe box 352, and is fixed in parallel with the safe box 352 for the overflow coin OC. A partition wall 388 with the opposing safe box 352 is opened at the lower side of the receiving opening 354 thus forming a through-hole 392, so that the fake coin FC dropped from the lower end of the second overflow coin guiding tube 2982 can drop into the fake coin storing unit 386 through the interior space of the safe box 352.

The fake coin distributing device 384 will now be described.

The fake coin distributing device 384 has a turn supporting shaft 396 arranged in the fake coin storing unit 386, and one end of a plate shaped fake coin distributing body 398 fixed to the turn supporting shaft 396. A distal end of the fake coin distributing body 398 is selectively located by an actuator 402 at a fake coin guiding position FGP arranged proximate to a slightly lower side of the lower end of the receiving opening 354, and an overflow coin guiding position OGP located in the vicinity of the upper end of the receiving opening 354. The fake coin distributing body 398 is usually arranged at the overflow coin guiding position, where when the collecting coin signal WCS is output, the actuator 402 moves the fake coin distributing body 384 from the overflow coin guiding position OGP to the fake coin guiding position FGP at a predetermined timing based on the collecting coin signal WCS to guide the fake coin to be collected WFC dropped from the lower end of the second overflow coin guiding tube 2982 to the fake coin storing unit 386. This movement preferably also uses a passing signal from an overflow storages sensor 348*o*. Therefore, the overflow coin OC and the genuine coin to be collected WTC are held in the safe box 352, and the fake coin to be collected WFC is guided by the fake coin distributing body 398 and held in the fake coin storing unit 386. Therefore, in the fourth example, the fake coin distributing device 384 is configured by the turn supporting shaft 394, the fake coin distributing body 398, and the actuator 402.

Even with respect to the coin recycle device 100 in the first example, the fake coin distributing device 384 may be arranged downstream of the lower end of the overflow coin guiding tube 298, similar to the fourth example, to hold the fake coin to be collected WFC in the fake coin storing unit 386 arranged in the lower space 102L of the housing 102.

Fifth Example

Figure 22:
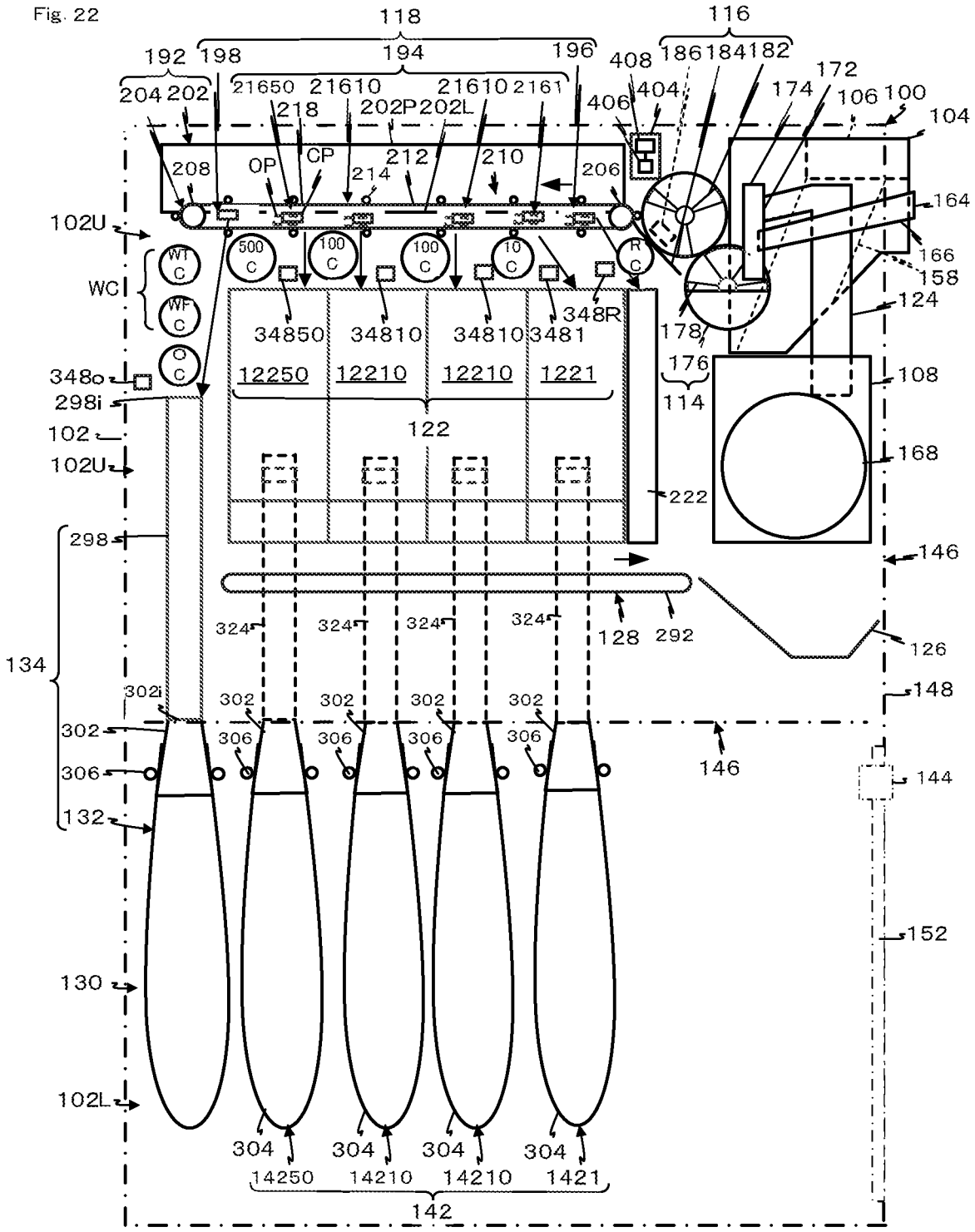
FIG. 22 is an explanatory view of an outline of a coin recycle device of a fifth example according to the present invention.

A fifth example will now be described with reference to FIG. 22.

The fifth example is an example in which a contaminated coin determining function is added to the collecting coin determining device 380 in the coin recycle device 100 in the third example. In other words, the collecting coin determining device 380 includes a contaminated coin determining device 404 for determining a contaminated coin CC that is contaminated, and in the fifth example, is configured by an image sensor 406 and a contamination determining device 408. The image sensor 406 is arranged facing a coin path at the downstream of the coin identifying device 116 and the upstream of the coin transporting and distributing device 118, and has a function of imaging the front surface or the back surface of the coin C moved along the guide 184 and acquiring image information IF, the image information ID being output to the contamination determining device 408. A known image sensor such as a CCD image sensor, a CMOS image sensor, and the like is used for the image sensor 406. The image sensor 406 can acquire the surface information, and thus can determine the abnormality in shape, and when the color image is acquired, can be used to determine the abnormality in color. Therefore, in the contamination determining device 408, coins with scratches, deformed coins, coins with rust, and the like can be determined in addition to the contaminated coins.

The contamination determining device 408 has a function of acquiring the outer shape information, the front surface pattern information, the back surface pattern information, the front surface color information, and the back surface color information based on the image information ID received from the image sensor 406, compares them with reference outer shape information, the reference front surface pattern information, the reference back surface pattern information, the reference front surface color information, and the reference back surface color information, and determining as the contaminated coin CC when at least one of such information takes an abnormal value deviated from the reference value, and outputting a contaminated coin signal CCS, and is normally configured by a microprocessor. Other than when comparing all of the outer shape information, the front surface pattern information, the back surface pattern information, the front surface color information, and the back surface color information with the reference value, some of the information may be compared with the reference value and the contaminated coin signal CCS may be output.

Figure 23:
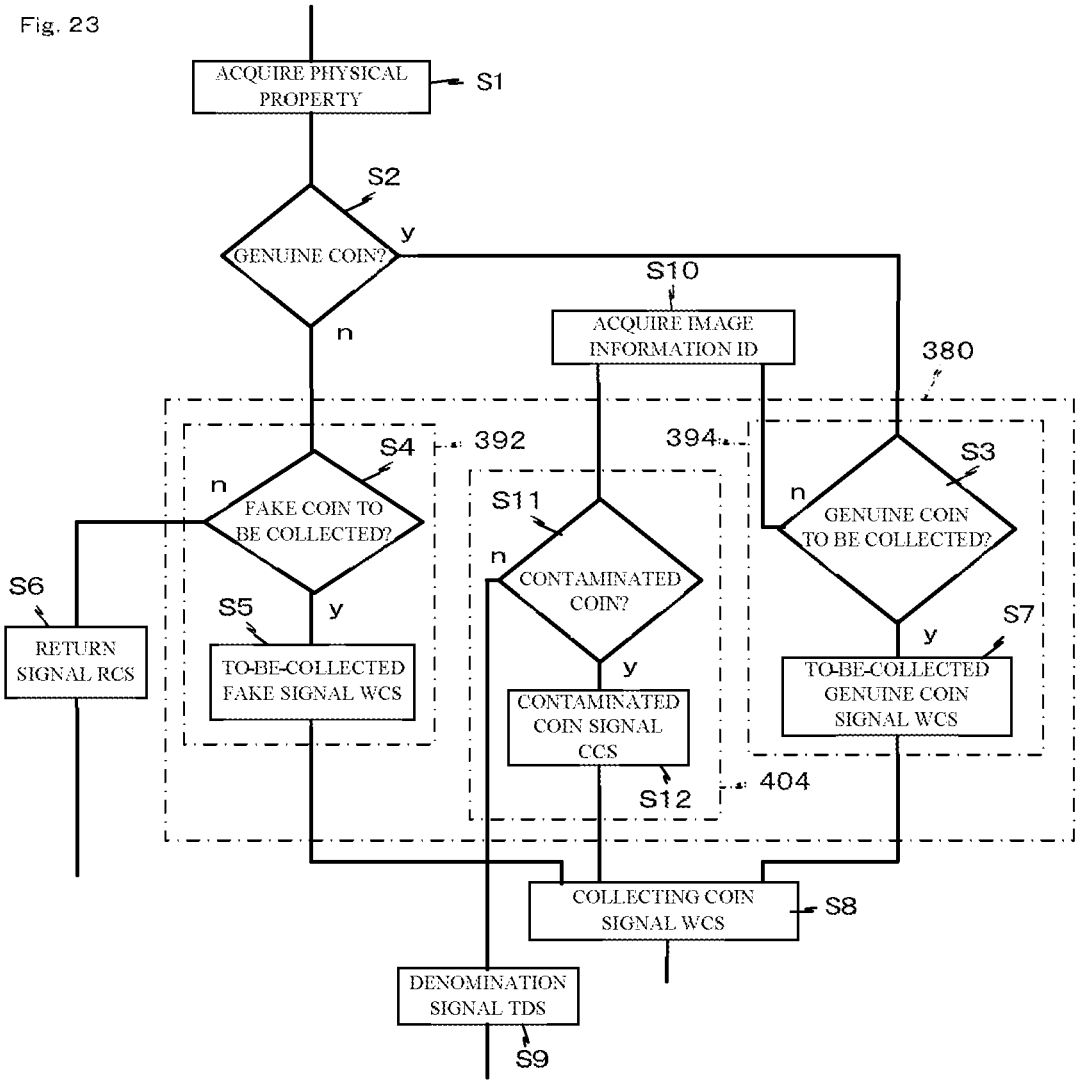
FIG. 23 is a flowchart describing an operation of the coin recycle device of the fifth example according to the present invention.

The operation of the fifth example will now be described with reference also to FIG. 23. The fifth example is an example in which the contaminated coin determining device 404 is added to the third example, and thus the description of steps S1 to S9 redundant with the description of the third example will be omitted, and the operations of steps S10 to S13 will be described.

When determined as not the genuine coin to be collected WTC in step S3, that is, when determined as the genuine coin TC to be held in the denomination storing and dispensing device 122, the process proceeds to step S10.

In step S10, the image information ID is acquired by the image sensor 406, and processes such as binarization is carried out based on the image information ID to obtain the outer shape information, the front surface pattern information, the back surface pattern information, the front surface color information, and the back surface color information, and thereafter, the process proceeds to step S11.

In step S11, the newly acquired outer shape information, the front surface pattern information, the back surface pattern information, the front surface color information, and the back surface color information are compared with the respective reference values, and if at least one of the information is deviated from the reference value, the process proceeds to step S12, and after the contaminated coin signal CCS is output, the process proceeds to step S8.

If the information is not deviated from the reference value, the process proceeds to step S9, and the subsequent processes are carried out similar to the coin C by denomination as described above.

In step S8, the collecting coin signal WCS is output. When the collecting coin signal WCS is output, the return open/close body 218R of the return coin slot 196 is maintained at the closed position SP configuring the guide rail 202L, similar to the description in the fourth example, and thus after passing the return open/close body 218R and being dropped to the overflow coin slot 198, the coin is dropped while being guided by the overflow coin guiding tube 298, and held in the overflow coin storing unit 132 through the overflow coin bag holding tube 302. Steps S11 and S12 correspond to the contaminated coin determining device 404 by the functions of the processing steps described above.

The contaminated coin determining device 404 can be determined also by the physical sensor 186, and the like using a coil other than the image sensor, and is not limited to the image sensor.

The acquisition of the image information ID by the image sensor 406 can be carried out at other appropriate timing immediately after step S1.

DESCRIPTION OF SYMBOLS

C coin
CC contaminated coin
CCS contaminated coin signal
FC fake coin
OC overflow coin
PO pay-out command
TC genuine coin
WFC fake coin to be collected
WFS collecting fake coin signal
WTC genuine coin to be collected
106 deposit opening
118 coin transporting and distributing device
122 denomination storing and dispensing device
128 pay out transporting device
126 pay-out opening
130 overflow coin storing chamber
136 outlet
138 pay-out distributing device
142 denomination collected coin storing unit
144, 360 locking device
152 door
198 overflow coin slot
298, 2982 overflow coin guiding tube
380 collecting coin determining device
384 fake coin distributing device
392 to-be-collected fake coin determining device
394 to-be-collected genuine coin determining device
396 turn supporting shaft
404 contaminated coin determining device
406 image sensor

The invention claimed is:

1. A coin recycle device including, a coin identifying device configured to determine a denomination of a coin input to a deposit opening of the coin recycle device by a user, a coin transporting and distributing device configured to transport a genuine coin identified by the coin identifying device, and allocates the coin for every denomination, a denomination storing and dispensing device configured to hold the coin allocated by denomination by the coin transporting and distributing device and that is arranged in parallel, and a pay out transporting device, arranged along the denomination storing and dispensing device, and configured to transport the coin paid out one at a time from the outlet of the denomination storing and dispensing device based on a pay-out command toward a pay-out opening; the coin recycle device comprising:

an overflow coin slot integrally arranged with the coin transporting and distributing device; and an overflow coin guiding tube arranged in parallel with the denomination storing and dispensing device configured to guide an overflow coin dropped to the overflow coin slot to an overflow coin storing unit; wherein a collecting coin determining device arranged with the coin recycle device is configured to determine a coin to be collected and to output a collecting coin signal based on either a to-be collected genuine coin signal or a to-be collected fake coin signal, wherein the collecting coin determining device includes a to-be-collected genuine coin determining device configured to determine that the coin to be collected is a genuine coin to be collected; and a to-be-collected fake coin determining device configured to determine that the coin to be collected is a fake coin to be collected;

the coin transporting and distributing device is configured to transport the genuine coin to be collected based on the to-be collected genuine coin signal, and to drop the genuine coin to be collected in the overflow coin slot;

the coin transporting and distributing device is further configured to transport the fake coin to be collected based on the to-be collected fake coin signal, and to drop the fake coin to be collected in the overflow coin slot;

when the collecting coin signal is output based on the to-be collected genuine coin signal, the coin recycle device is configured to guide the genuine coin to be collected dropped in the overflow coin slot to the overflow coin guiding tube;

when the collecting coin signal is output based on the to-be collected fake coin signal, the coin recycle device is configured to guide the fake coin to be collected dropped in the overflow coin slot to the overflow coin guiding tube;

the payout transporting device includes a left guide plate and a right guide plate arranged on an upper left and right sides of a flat belt arranged between a front roller and a rear roller;

a pay-out distributing device includes a payout passage that is configured to guide coins paid out from an exit of the denomination storing and dispensing device to the payout transporting device, or a denomination guiding passage to guide the coins to a drop slot, a distributing body, a distributing body moving device and the pay-out distributing device;

a distribution body is selectively positioned by a distribution body moving device at pay-out position for guiding the coin to the payout transporting device or collecting position for guiding the coin to the drop slot;

the distributing body is selectively positioned by the distributing body moving device at a withdrawing position for guiding the coin to the payout transporting device or the collecting position for guiding the coin to the drop slot;

the distributing body moving device includes a solenoid, a rod body, an elastic body, and a coupling shaft; and a distributing body position detecting device that includes a detection recess, a first optical sensor, and a second optical sensor formed in the rod body, and when the detection recess is detected by the first optical sensor or the second optical sensor, the position of the distributing body is discriminated whether at the pay-out position or the collecting position.

2. The coin recycle device according to claim 1, wherein a fake coin distributing device configured to allocate the coin to an overflow coin storage box and the fake coin to be collected based on a to-be-collected fake coin signal from the collecting coin determining device is arranged downstream of an overflow coin guiding tube lower end opening of the overflow coin guiding tube; and the coin recycle device is configured to allocate the fake coin to be collected to a fake coin storing unit different from the overflow coin storing unit.

3. The coin recycle device according to claim 1, wherein the coin recycle device is configured to output the collecting coin signal based on a contaminated coin signal.

4. The coin recycle device according to claim 3, wherein the collecting coin determining device includes an image sensor.

* * * * *